US007427213B2

(12) United States Patent
Kondou et al.

(10) Patent No.: US 7,427,213 B2
(45) Date of Patent: Sep. 23, 2008

(54) CONNECTOR SOCKET MODULE CONNECTING A CABLE-SIDE CONNECTOR PLUG TO A MAIN BOARD

(75) Inventors: Takahiro Kondou, Shinagawa (JP); Tadashi Kumamoto, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/543,048

(22) Filed: Oct. 5, 2006

(65) Prior Publication Data

US 2007/0212933 A1 Sep. 13, 2007

(30) Foreign Application Priority Data

Mar. 10, 2006 (JP) ..... 2006-066442
Apr. 28, 2006 (JP) ..... 2006-125774

(51) Int. Cl.
*H01R 13/60* (2006.01)
*H01R 13/66* (2006.01)

(52) U.S. Cl. ..... 439/541.5

(58) Field of Classification Search ..... 439/541.5, 439/540.1, 65, 939
See application file for complete search history.

(56) References Cited

U.S. PATENT DOCUMENTS 4,869,677 A * 9/1989 Johnson et al. ..... 439/80
5,080,609 A * 1/1992 Fabian et al. ..... 439/541.5
5,085,590 A * 2/1992 Galloway ..... 439/95
5,167,531 A * 12/1992 Broschard et al. ..... 439/541.5
5,545,057 A * 8/1996 Tan et al. ..... 439/540.1
5,613,875 A * 3/1997 Yang ..... 439/541.5
5,755,592 A * 5/1998 Hillbish et al. ..... 439/541.5
6,302,731 B1 * 10/2001 Kring ..... 439/541.5
6,364,698 B1 * 4/2002 Tsai ..... 439/541.5
7,261,592 B2 * 8/2007 Korsunsky et al. ..... 439/541.5
2007/0072444 A1 * 3/2007 Okuyama et al. ..... 439/65

FOREIGN PATENT DOCUMENTS

JP 09-006479 1/1997
JP 2002-042926 2/2002

* cited by examiner

*Primary Examiner*—Hae Moon Hyeon
(74) *Attorney, Agent, or Firm*—Staas & Halsey LLP

(57) ABSTRACT

A connector socket module is disclosed that includes a connector socket module main body and a holder member configured to hold the connector socket module main body. The connector socket module main body includes a relay board; multiple I/O connector sockets of which a corresponding one is to be connected to a connector plug, the I/O connector sockets being arranged on a first face of the relay board; and a mounting connector mounted on a second face of the relay board facing away from the first face to be connected to a connector on a main board. The holder member covers a side of the connector socket module main body on the side of the second face of the relay board, is formed by bending a metal plate member of a predetermined shape, and has a part to be fixed to the main board.

12 Claims, 28 Drawing Sheets

CONNECTOR SOCKET MODULE CONNECTING A CABLE-SIDE CONNECTOR PLUG TO A MAIN BOARD

The present application is based on Japanese Priority Patent Applications No. 2006-066442, filed on Mar. 10, 2006, and No. 2006-125774, filed on Apr. 28, 2006, the entire contents of which are hereby incorporated by reference, the benefit of the earlier filing date of which is claimed herein under 35 USC §119(e), 37 CFR 1.78 and MPEP §201.11.

BACKGROUND OF THE INVENTION

1. Field of the Invention

It is desirable that servers and routers have structures that are easy to design, assemble, and maintain.

2. Description of the Related Art

FIGS. 1 and 2 are diagrams showing part of a conventional server 10. The server 10 is a type having a large number of I/O (Input/Output) connectors. Two main boards 20 and 21 are incorporated in a chassis 11. Multiple I/O connector sockets 30 provided side by side at the end of the main board 20 and multiple I/O connector sockets 31 provided side by side at the end of the main board 21 are arranged in first and second rows, respectively, projecting out from the opening of a front panel 12.

The server 10 is used with a cable-side connector plug 40 at the end of a cable 39 being connected to one of the I/O connector sockets 30 and 31.

Reference may be made to Japanese Laid-Open Patent Application No. 9-6479 for the above-described technique.

The above-described server 10 requires the two main boards 20 and 21 in order to arrange the connector sockets 30 and 31 in two rows. This requires a separate control circuit to be configured for each of the two main boards 20 and 21, thus making design and assembly difficult.

Further, if one of the I/O connector sockets 30 or 31 arranged in a row fails, it is necessary to replace the main board 20 or 21, thus also making maintenance difficult.

SUMMARY OF THE INVENTION

Embodiments of the present invention may solve or reduce one or more of the above-described problems.

According to one embodiment of the present invention, there is provided a connector socket module in which the above-described problems are solved.

According to one embodiment of the present invention, there is provided a connector socket module to be mounted on a main board so as to connect a cable-side connector plug and the main board, the connector socket module including: a connector socket module main body; and a holder member configured to hold the connector socket module main body, wherein the connector socket module main body includes: a relay board; a plurality of I/O connector sockets of which a corresponding one is to be connected to the cable-side connector plug, the I/O connector sockets being arranged on a first face of the relay board; and a mounting connector to be connected to a connector on the main board, the mounting connector being mounted on a second face of the relay board, the second face facing away from the first face of the relay board; and the holder member covers a side of the connector socket module main body on a side of the second face of the relay board, is formed by bending a metal plate member of a predetermined shape, and has a part to be fixed to the main board.

According to one embodiment of the present invention, there is provided an apparatus including: a single main board; a connector socket module mounted on the main board; and a panel configured to form an exterior of the apparatus, wherein the connector socket module includes: a connector socket module main body; and a holder member configured to hold the connector socket module main body and to cover a side of the connector socket module main body, the holder member being formed by bending a metal plate member of a predetermined shape; the connector socket module main body and the holder member are fixed to each other; and the connector socket module has the holder member screwed to the single main board, and has the connector socket module main body screwed to the panel.

According to one embodiment of the present invention, there is provided a connector socket module to be mounted on a main board so as to connect a cable-side connector plug and the main board, the connector socket module including: a connector socket module main body; and a holder structure configured to hold the connector socket module main body, wherein the connector socket module main body includes: a relay board; a plurality of I/O connector sockets of which a corresponding one is to be connected to the cable-side connector plug, the I/O connector sockets being arranged on a first face of the relay board; and a mounting connector to be connected to a connector on the main board, the mounting connector being mounted on a second face of the relay board, the second face facing away from the first face of the relay board; the holder structure is positioned on a side of the second face of the relay board of the connector socket module main body, the holder structure including: a first frame member shaped so as to extend over the second face of the relay board between a first end and a second end thereof, the first frame member including a relay board reception part and a part to be fixed to the main board, the relay board reception part being configured to receive the second face of the relay board at the first and second ends thereof; a second frame member shaped so as to extend over the second face of the relay board between the first and second ends thereof, the second frame member including a hook part configured to engage and secure the first face of the relay board at the first and second ends thereof, the second frame member being positioned across the first frame member from the relay board with the hook part engaging and securing the first face of the relay board at the first and second ends thereof; and a screw member screwed into a screw hole of the second frame member so that an end of the screw member presses the first frame member in a direction away from the second frame member; and the relay board has a first part at the first end thereof and a second part at the second end thereof held between the hook part of the second frame member and the relay board reception part of the first frame member.

According to one aspect of the present invention, the number of main boards required can be reduced from the conventional two or more to one by employing connector socket modules according to the present invention, which are mounted and arranged on a main board. This makes it easy to design and assemble a server.

According to one aspect of the present invention, if one of the I/O connector sockets of connector socket modules according to the present invention fails, the connector socket module having the failed one of the I/O connector sockets may be removed and replaced with a new connector socket module. Thus, there is no need to replace the main board, so that it is easy to perform maintenance.

Further, according to one aspect of the present invention, since a holder member is formed by bending a metal plate member of a predetermined shape, a connector socket module can be reduced in size, weight, and manufacturing cost compared with the case of using a die-cast component as the holder member.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

First Embodiment

Figure 3:
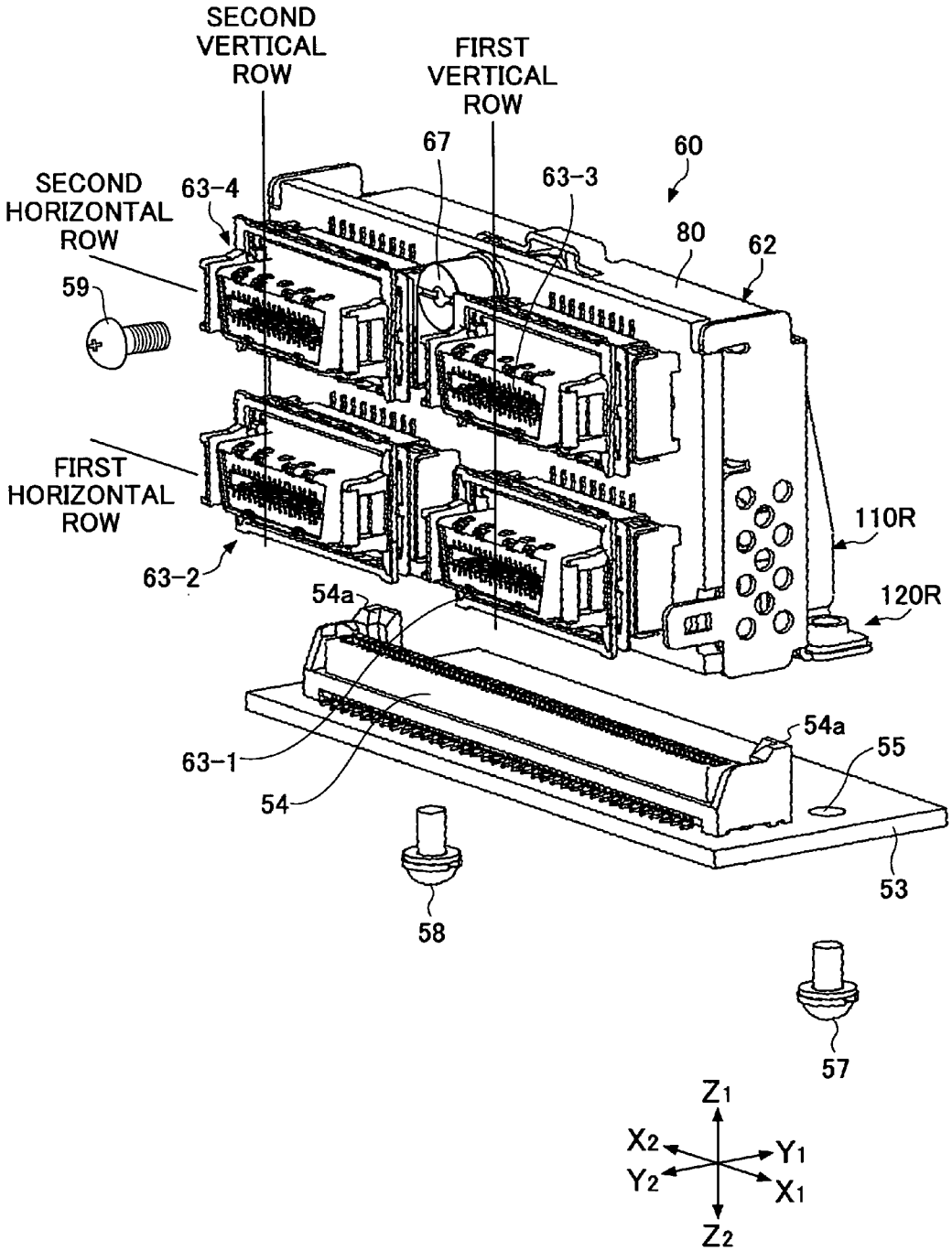
FIG. 3 is a diagram showing a connector socket module and a corresponding part of a main board according to a first embodiment of the present invention.

FIG. 3 is a diagram showing a connector socket module 60 and a corresponding part of a main board 53 according to a first embodiment of the present invention.

Figure 4:
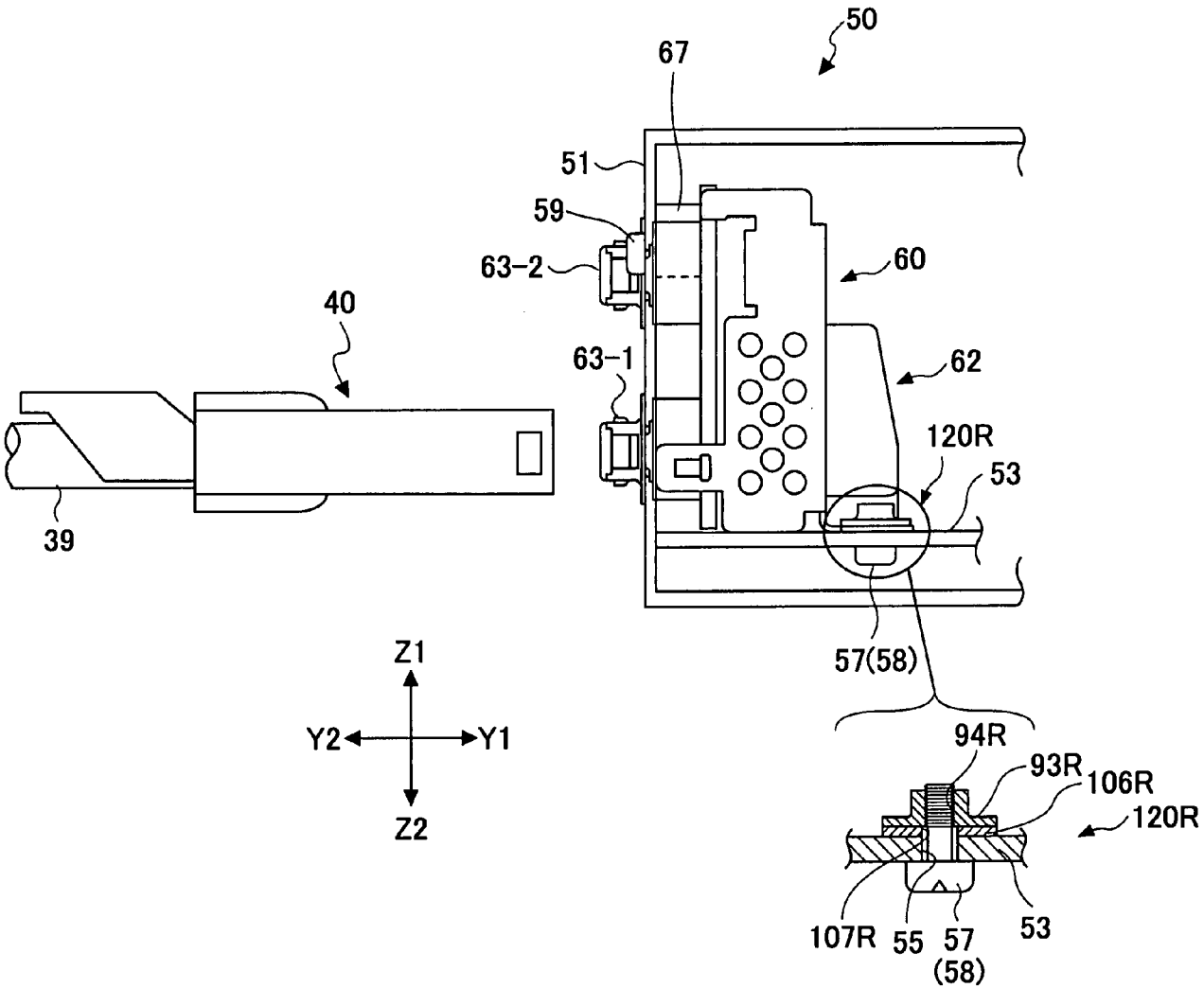
FIG. 4 is a diagram showing part of a server in which the connector socket module of FIG. 3 is incorporated according to the first embodiment of the present invention.
Figure 5:
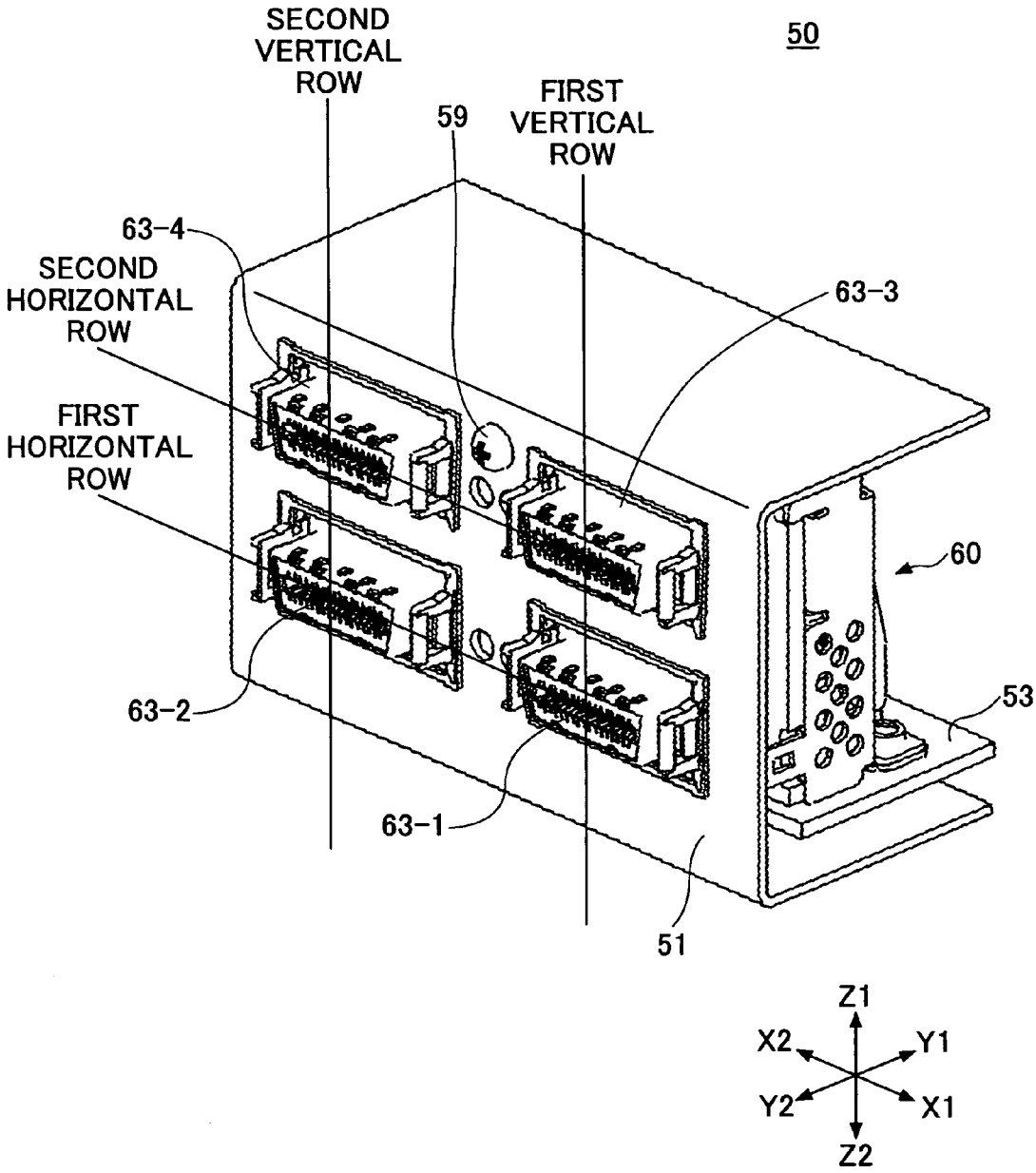
FIG. 5 is a perspective view of the part of the server shown in FIG. 4 according to the first embodiment of the present invention.
Figure 6:
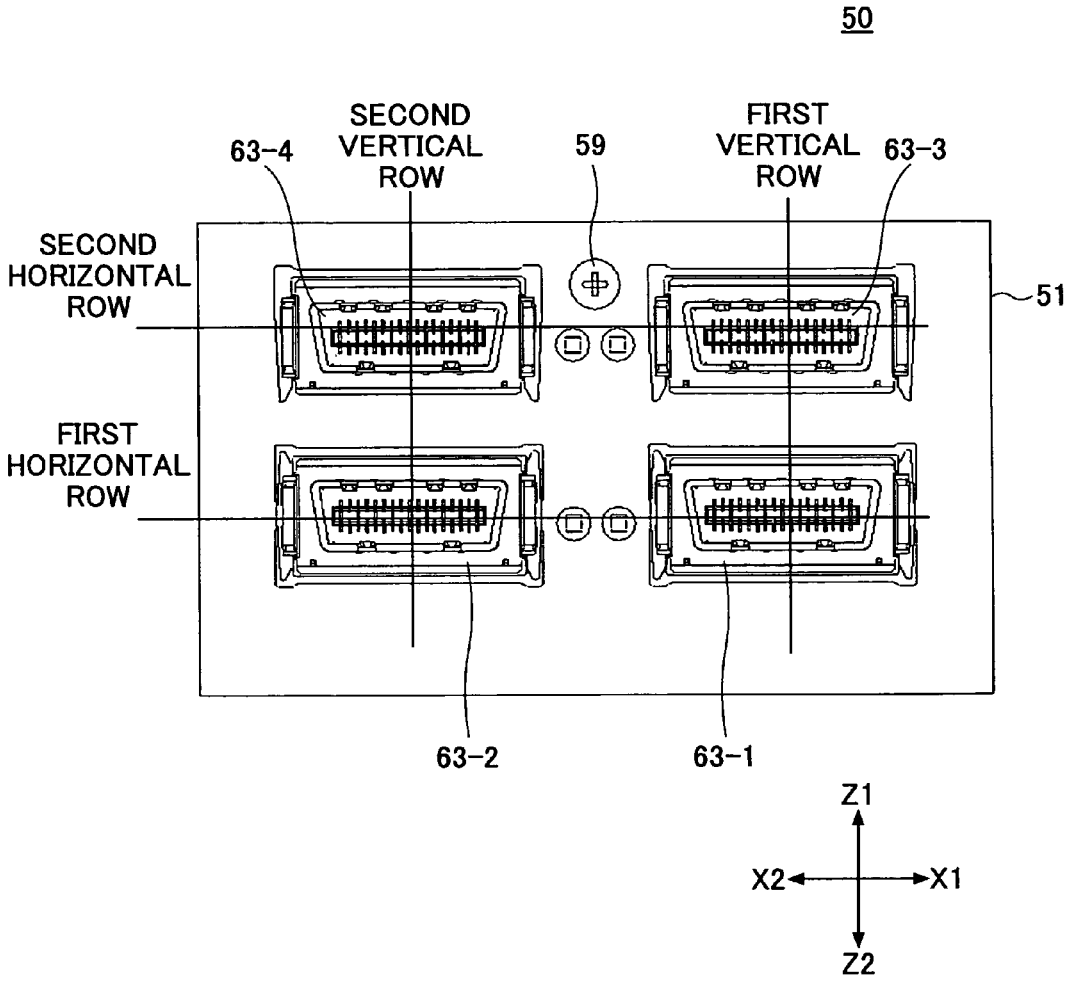
FIG. 6 is a front view of the part of the server shown in FIG. 4 according to the first embodiment of the present invention.

FIGS. 4, 5, and 6 are diagrams showing part of a server 50 in which the connector socket module 60 of FIG. 3 is incorporated. The actual external shape of the server 50 is elongated along the X-axis.

Figure 1:
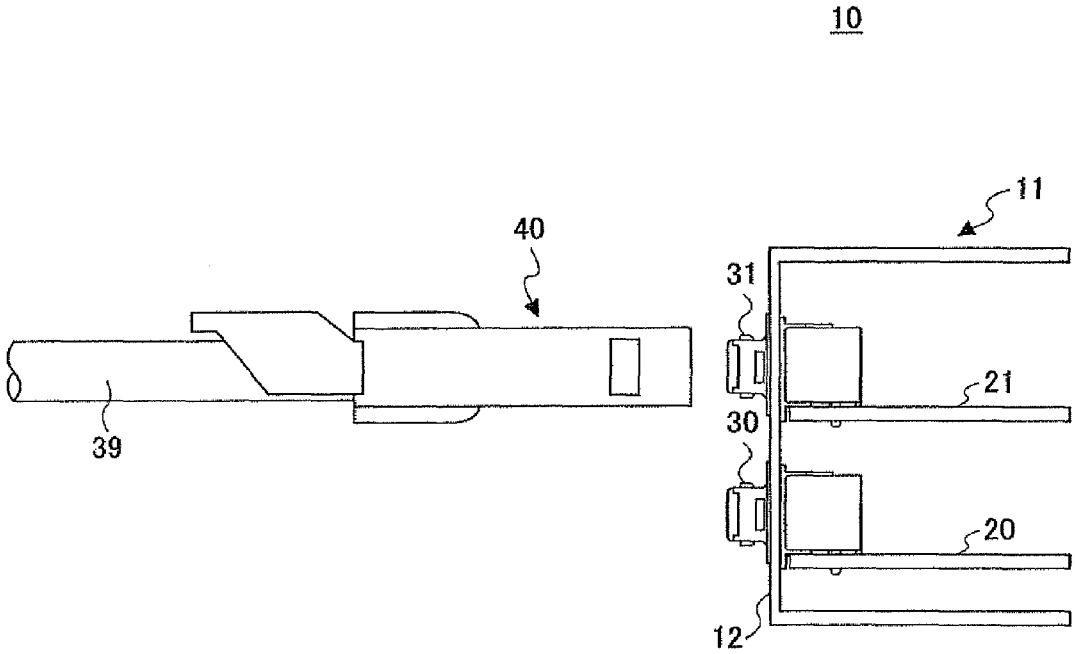
FIG.1 PRIOR ART
FIG. 1 is a diagram showing part of a conventional server.
Figure 2:
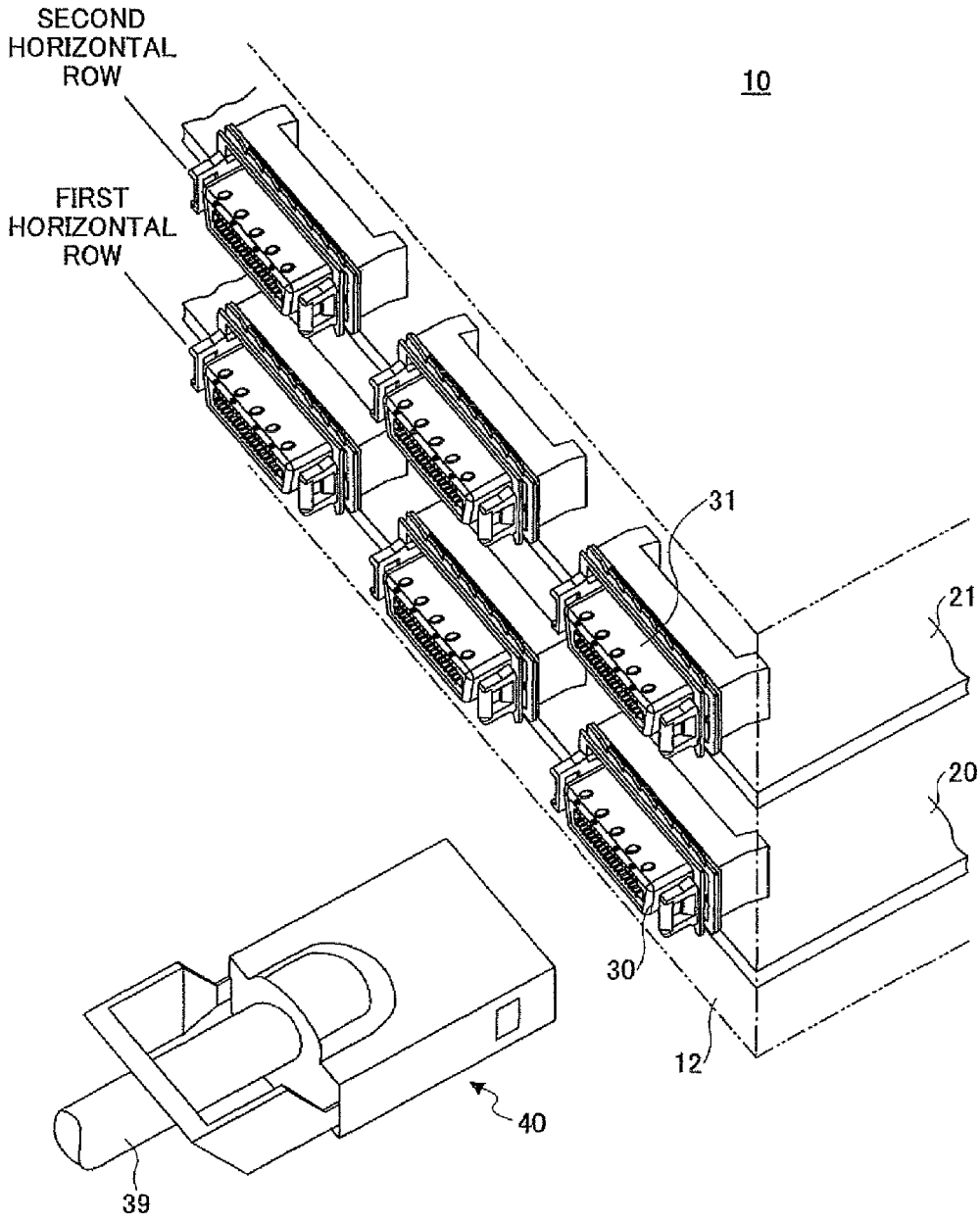
FIG.2 PRIOR ART
FIG. 2 is a perspective view of the part of the conventional server shown in FIG. 1.

In appearance, like the server 10 shown in FIGS. 1 and 2, the server 50 has I/O connector sockets 63-1 and 63-2 arranged in a first horizontal row and I/O connector sockets 63-3 and 63-4 arranged in a second horizontal row so as to project from the corresponding openings of a front panel 51. However, unlike the server 10 shown in FIGS. 1 and 2, the server 50 has the single main board 53 inside a chassis 52. Multiple connector socket modules 60 are arranged along an edge of the main board 53, being connected thereto through connectors. The server 50 is used with the cable-side connector plug 40 being connected to one of the I/O connector sockets 63-1 through 63-4.

In the drawings, X1 and X2 arrows indicate the width directions of the server 50 and the connector socket module 60, Y1 and Y2 arrows indicate the depth (front-rear) directions of the server 50 and the thickness direction of the connector socket module 60, and Z1 and Z2 arrows indicate the height directions of the server 50 and the connector socket module 60.

[General Configuration of the Connector Socket Module 60]

Figure 7:
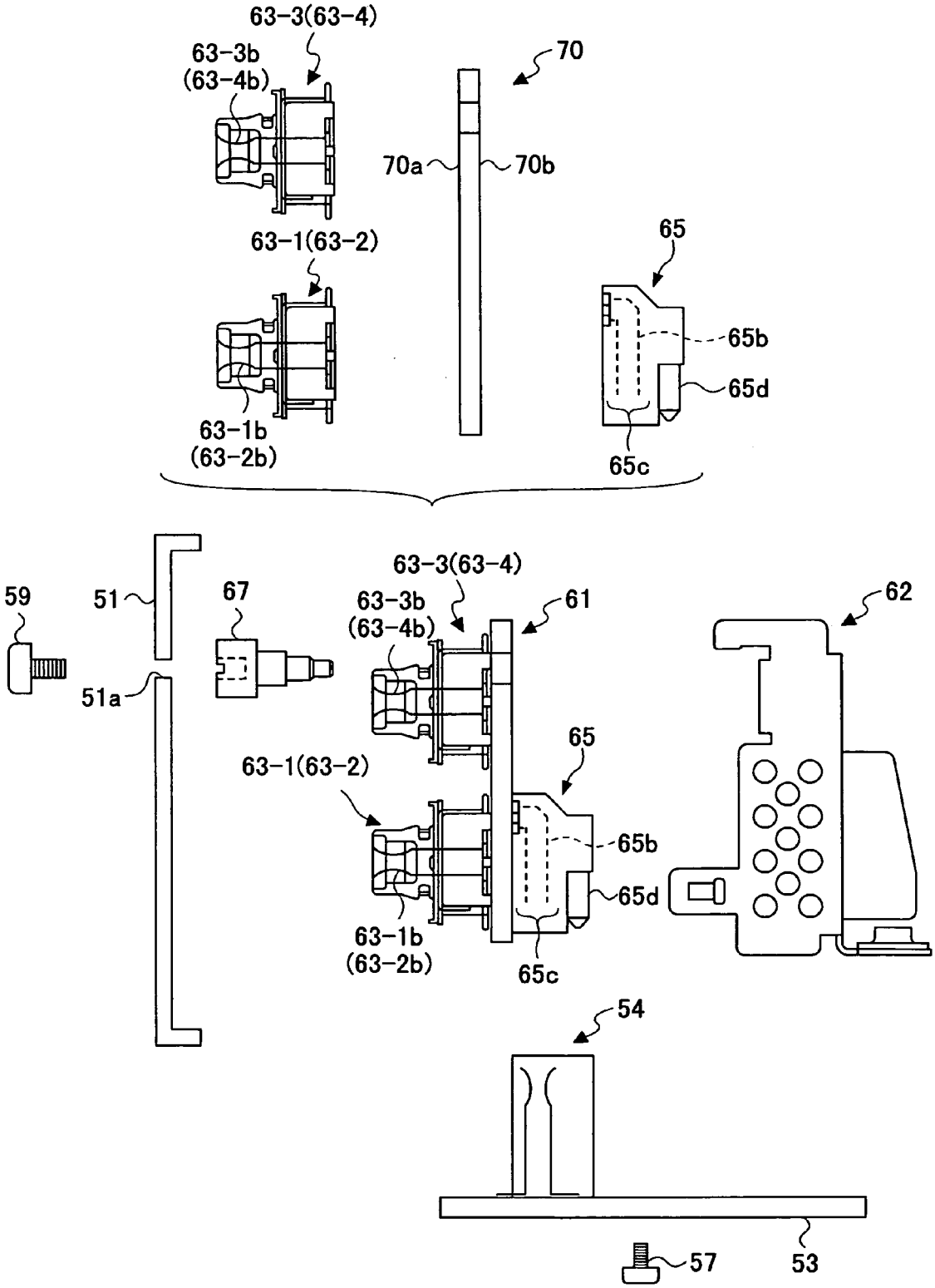
FIG. 7 is an exploded view of the connector socket module and part of the server according to the first embodiment of the present invention.
Figure 8:
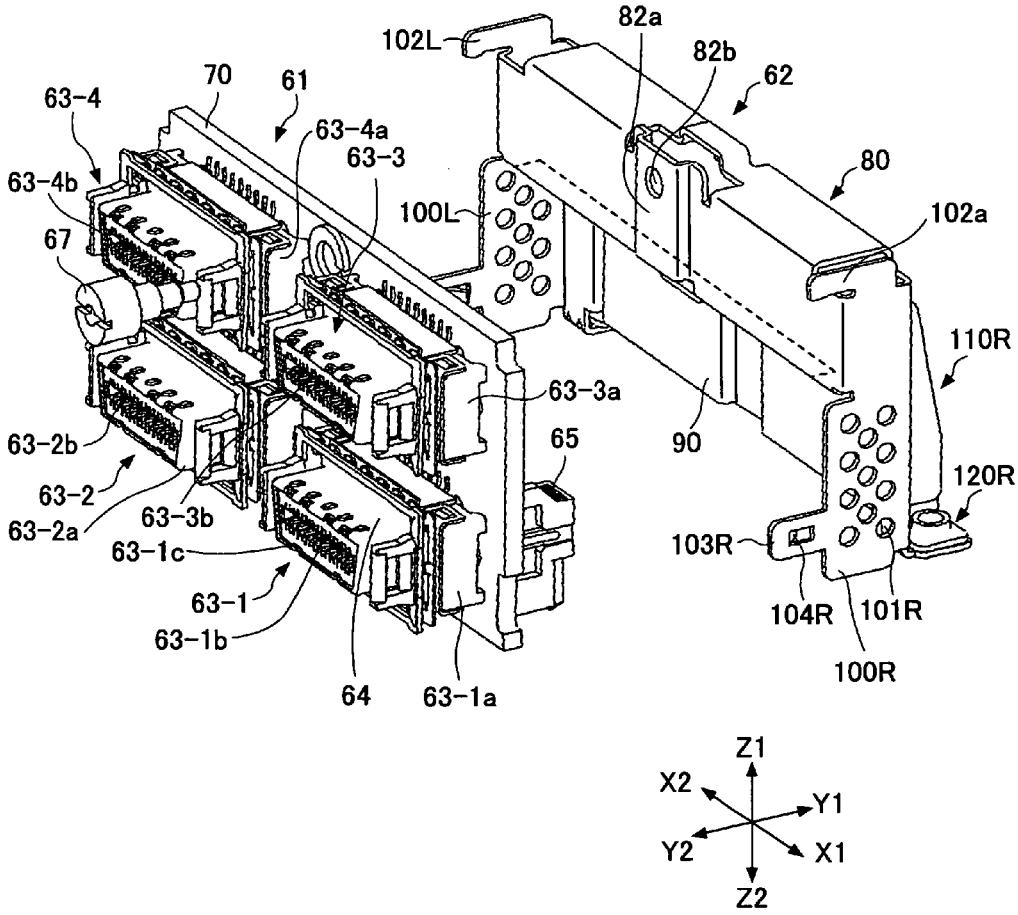
FIG. 8 is a front exploded perspective view of the connector socket module, in which the connector socket module is shown disassembled into a connector socket module main body and a holder member, according to the first embodiment of the present invention.
Figure 9:
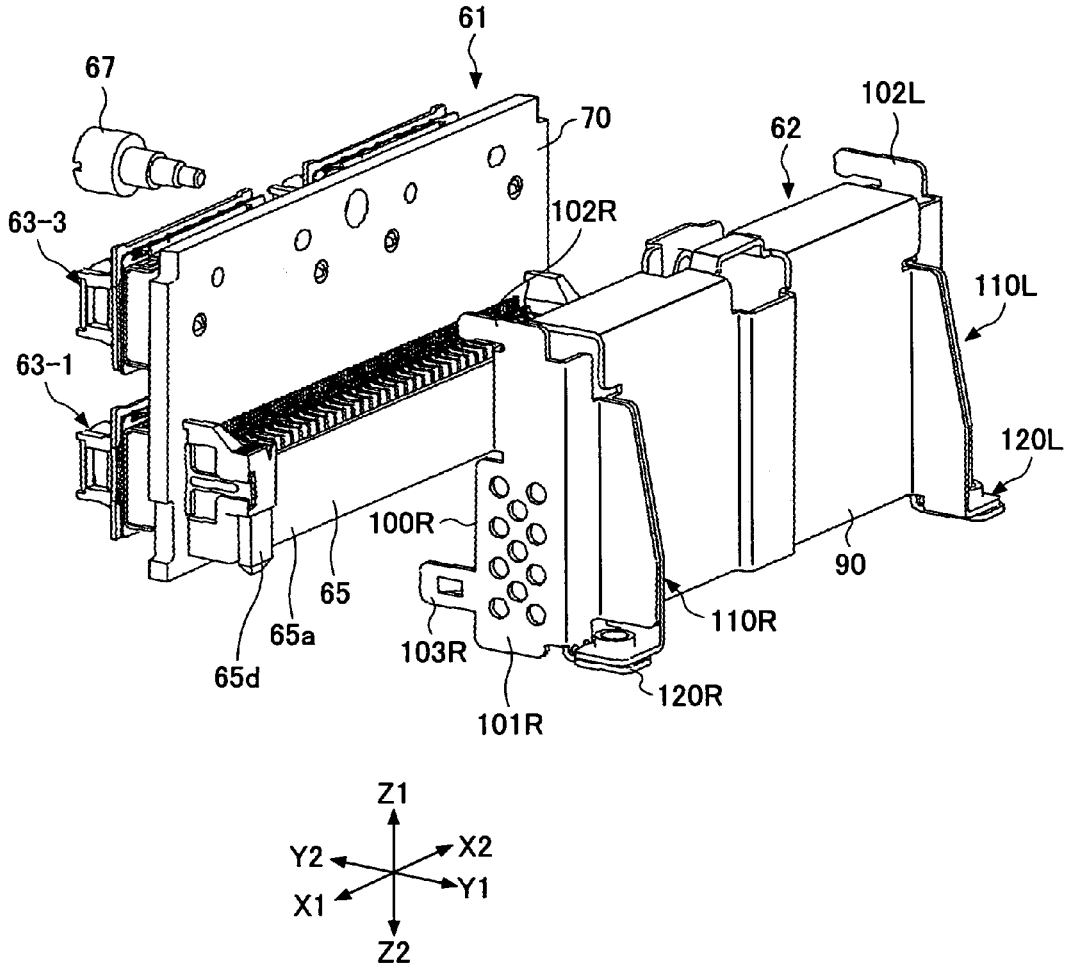
FIG. 9 is a rear exploded perspective view of the connector socket module, in which the connector socket module is shown disassembled into the connector socket module main body and the holder member, according to the first embodiment of the present invention.
Figure 10:
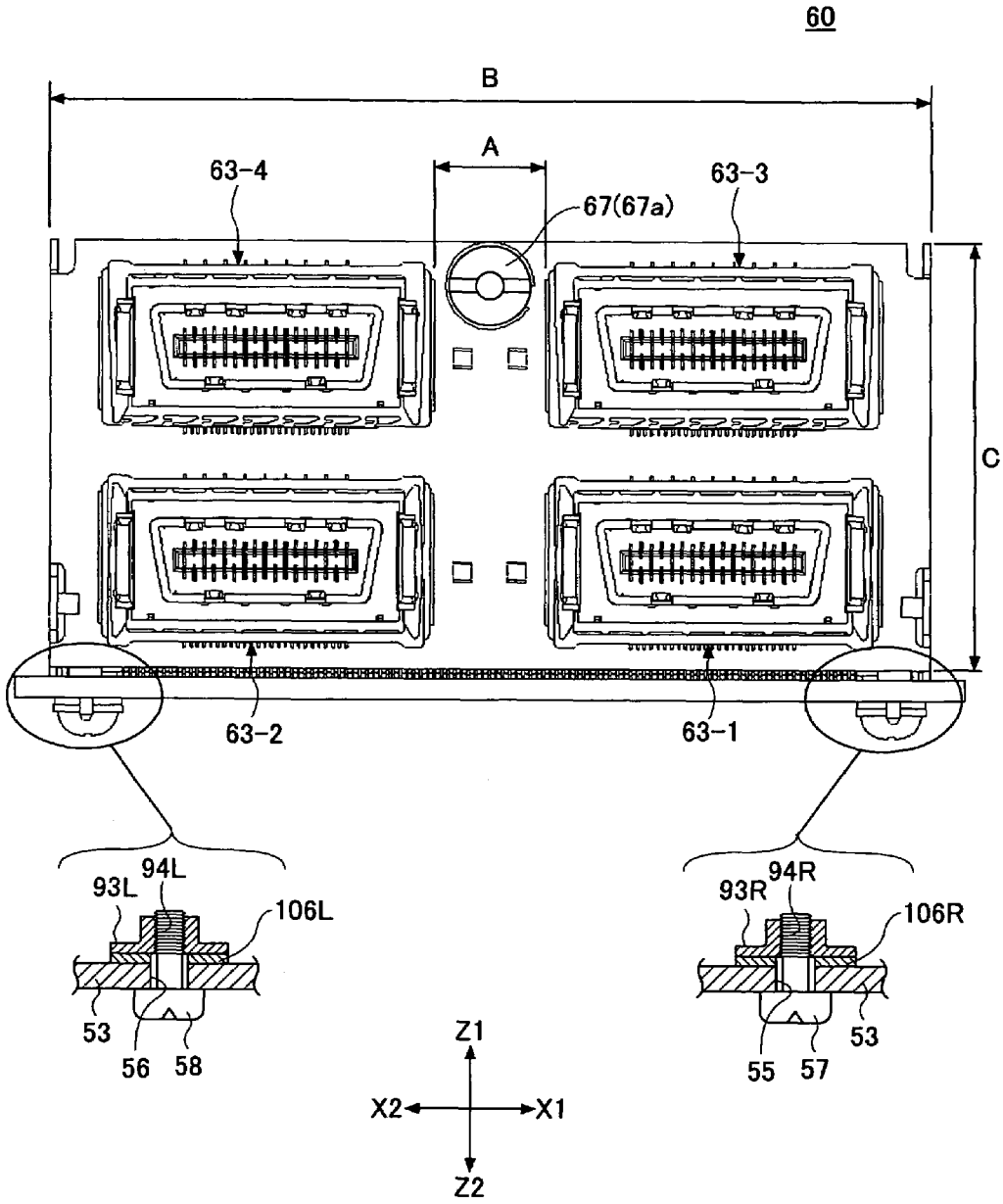
FIG. 10 is a front view of the connector socket module according to the first embodiment of the present invention.
Figure 11:
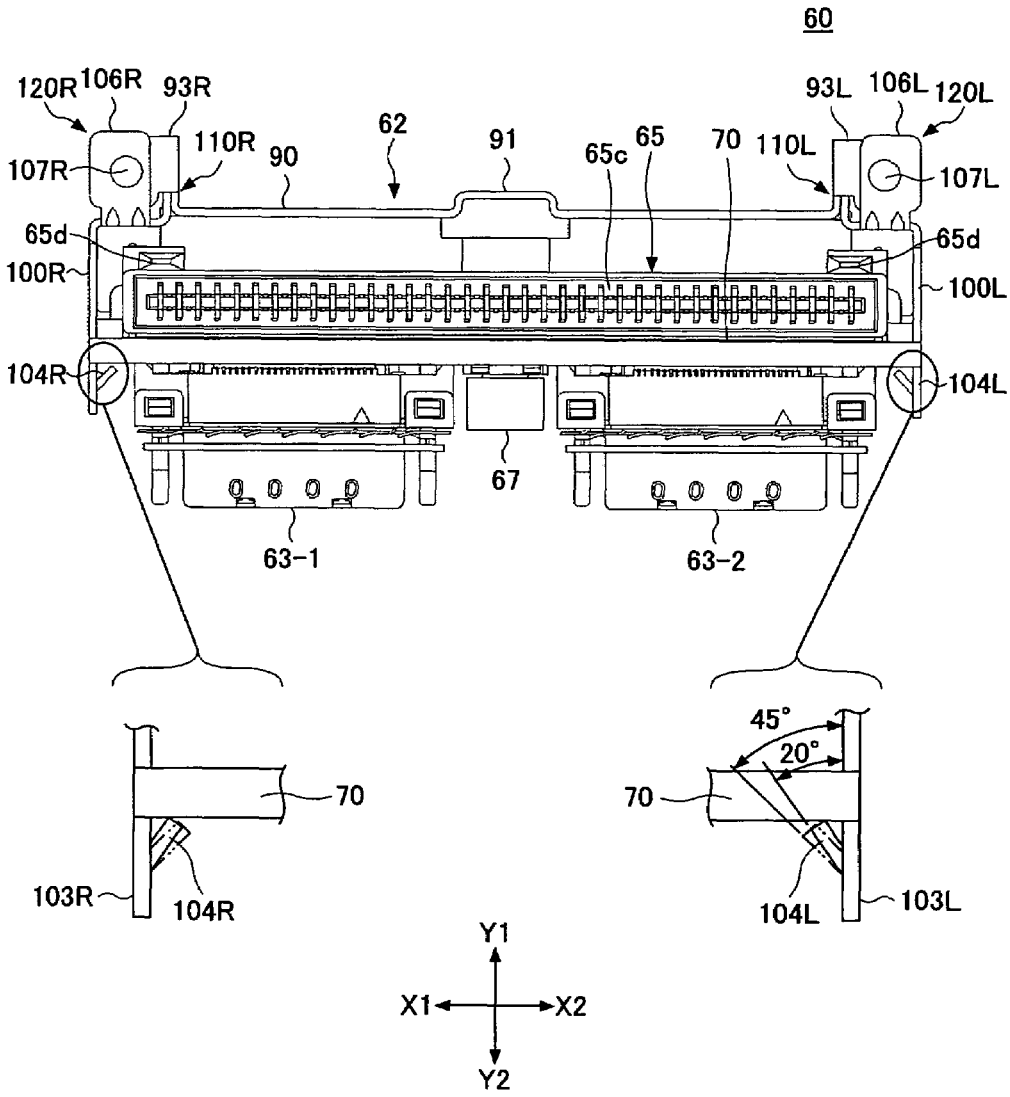
FIG. 11 is a bottom view of the connector socket module according to the first embodiment of the present invention.
Figure 12:
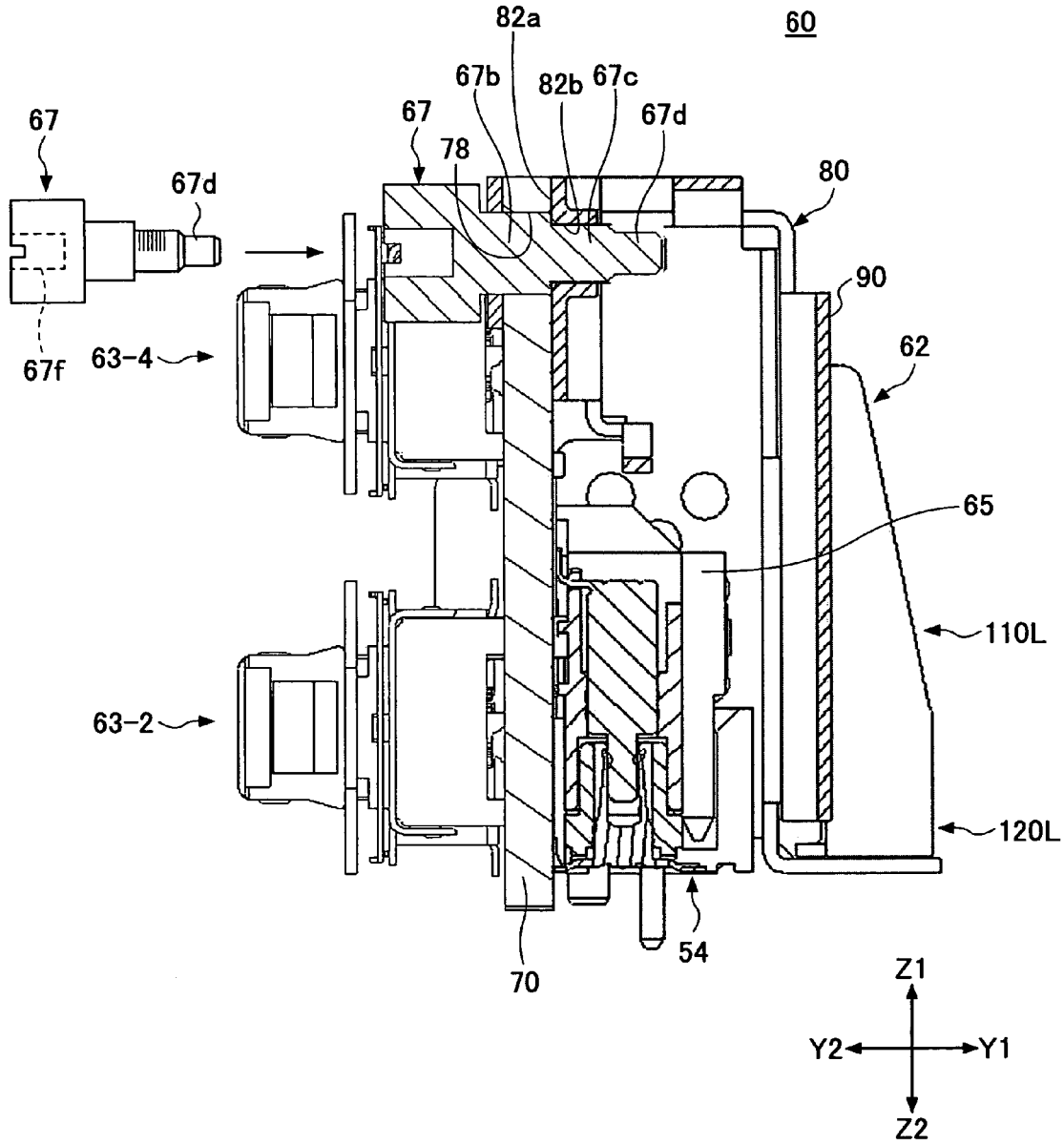
FIG. 12 is a cross-sectional view of the connector socket module according to the first embodiment of the present invention.

FIG. 7 is an exploded view of the connector socket module 60 and part of the server 50. FIGS. 8 and 9 are exploded perspective views of the connector socket module 60, in which the connector socket module 60 is shown disassembled into a connector socket module main body 61 and a holder member 62. FIG. 10 is a front view of the connector socket module 60. FIG. 11 is a bottom view of the connector socket module 60. FIG. 12 is a cross-sectional view of the connector socket module 60 with a main-board-side connector 54 connected thereto.

The connector socket module 60 has the holder member 62 attached to the rear side of the connector socket module main body 61 with a special shaped screw member 67, so that the holder member 62 holds the connector socket module main body 61.

The connector socket module 60 has the four I/O connector sockets 63-1 through 63-4 arranged in a matrix manner on its front side, and has one mounting connector 65 on its rear side. The mounting connector 65 is connected to the main-board-side connector 54 and part of the holder member 62 is fixed to the main board 53 with screws 57 and 58, so that the connector socket module 60 is mounted on the main board 53.

The connector socket module 60 can be provided side by side with other connector socket modules 60 on the main board 53 so that the multiple I/O connector sockets 63-1 through 63-4 are disposed in a first horizontal row and a second horizontal row at an end of the main board 53.

Further, if one of the I/O connector sockets 63-1 through 63-4 of the connector socket module 60 fails, the connector socket module 60 can be removed from the main board 53 and replaced with a new one.

[Connector Socket Module Main Body 61]

A front perspective view of the connector socket module main body 61 is shown in part of FIG. 8. A rear perspective view of the connector socket module main body 61 is shown in part of FIG. 9. An exploded view of the connector socket module main body 61 is shown in part of FIG. 7.

The connector socket module main body 61 includes a relay board 70, the four I/O connector sockets 63-1 through 63-4 provided with a matrix arrangement on a front face 70*a* of the relay board 70, and the single mounting connector 65 provided on a rear face 70*b* of the relay board 70. The four I/O connector sockets 63-1 through 63-4 are provided to be horizontally long, and are disposed in two horizontal rows and two vertical rows.

Figure 13B:
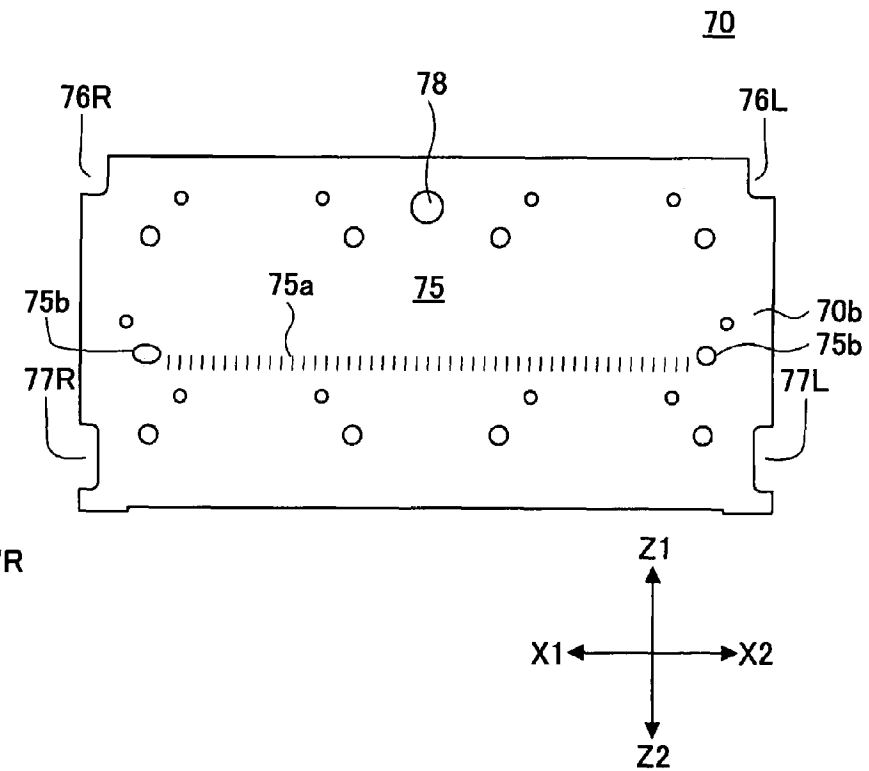
FIG. 13B is a diagram showing a rear face of the relay board according to the first embodiment of the present invention.
Figure 13A:
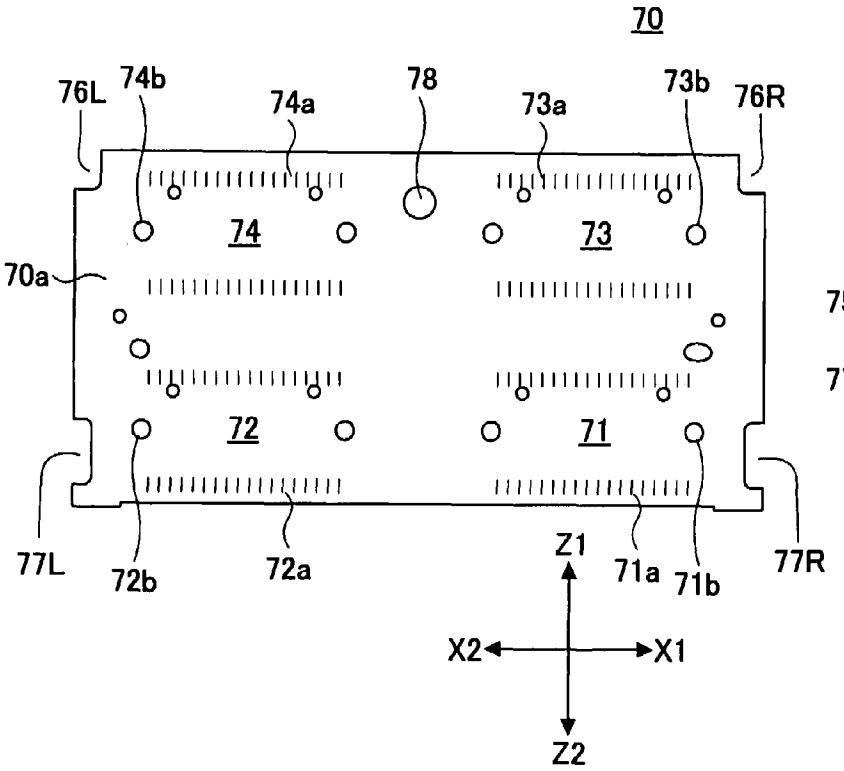
FIG. 13A is a diagram showing a front face of a relay board according to the first embodiment of the present invention.

FIG. 13A is a diagram showing the front face 70*a* of the relay board 70. FIG. 13B is a diagram showing the rear face 70*b* of the relay board 70. The relay board 70 has such size that the four I/O connector sockets 63-1 through 63-4 can be mounted thereon in a matrix manner. I/O connector socket mounting parts 71, 72, 73, and 74 are formed side by side in a matrix manner on the front face 70*a*. A mounting connector mounting part 75 is formed on the rear face 70*b*.

Referring to FIG. 13A, each of the I/O connector socket mounting parts 71 through 74 has a shape elongated along the X-axis. The I/O connector socket mounting parts 71, 72, 73, and 74 have respective pads 71*a*, 72*a*, 73*a*, and 74*a* arranged side by side along the X-axis. Further, the I/O connector socket mounting parts 71, 72, 73, and 74 have respective positioning holes 71*b*, 72*b*, 73*b*, and 74*b* provided at each end along the X-axis.

Referring to FIG. 13B, the mounting connector mounting part 75 has a shape elongated along the X-axis. The mounting connector mounting part 75 has pads 75*a* arranged side by side along the X-axis, and has positioning holes 75*b* provided at each end along the X-axis. The number of pads 75*a* is equal to the total number of pads 71*a* through 74*a* of the I/O connector socket mounting parts 71 through 74.

Although not graphically illustrated, an interconnection pattern, vias, and a ground pattern are formed on the relay board 70 so that the pads 71*a* through 74*a* of the I/O connector socket mounting parts 71 through 74 are electrically connected to the pads 75*a* of the mounting connector mounting part 75. The relay board 70 electrically connects the I/O connector sockets 63-1 through 63-4 on the front face 70*a* side and the mounting connector 65 on the rear face 70*b* side, thus serving as a relay between the I/O connector sockets 63-1 through 63-4 and the mounting connector 65.

Further, the relay board 70 has cutout parts 76R and 76L formed in its upper (Z1-side) corners. Further, the relay board 70 has cutout parts 77R and 77L formed at the X1 end and the X2 end, respectively, in a lower (Z2-side) part thereof.

Further, the relay board 70 has a through hole 78 for the special shaped screw member 67 formed in the center of an upper part thereof.

Referring to FIG. 8, the I/O connector socket 63-1 includes an insulating main body part 63-1*a* and contacts 63-1*b*. The contacts 63-1*b* are arranged in the insulating main body part 63-1*a* with such a disposition as to enable differential transmission. The I/O connector socket 63-1 further includes a fit connection part 63-1*c* at its end. The fit connection part 63-1*c* covers an end part of the main body part 63-1*a* with a shield cover 64. The other I/O connector sockets 63-2 through 63-4 have the same structure as the I/O connector socket 63-1. The I/O connector socket 63-1 is surface-mounted on the I/O connector socket mounting part 71, being positioned with the projections (not graphically illustrated) of the main body part 63-1*a* fitted into the positioning holes 71*b* and having the contacts 63-1*b* soldered to the pads 71*a*. The other I/O connector sockets 63-2 through 63-4 are also surface-mounted on the I/O connector socket mounting parts 72 through 74, respectively, being positioned with the projections of respective main body parts 63-2*a* through 63-4*a* fitted into the corresponding positioning holes 72*b* through 74*b* and having respective contacts 63-2*b* through 63-4*b* soldered to the corresponding pads 72*a* through 74*a*.

Here, the I/O connector sockets 63-1 through 63-4 are disposed with a minimum distance A along the X-axis (FIG. 10) that can accommodate the special shaped screw member 67 being provided between the I/O connector sockets 63-1 and 63-3 and the I/O connector sockets 63-2 and 63-4. Further, the distance along the Z-axis between the I/O connector sockets 63-1 and 63-2 and the I/O connector sockets 63-3 and 63-4 is reduced as much as possible. This reduces the X-axial length of the relay board 70 and the X-axial length of the connector socket module main body 61. As a result, both of an X-axial length B and a Z-axial length (height) C of the connector socket module 60 are reduced (see FIG. 10).

Referring to FIG. 9, the mounting connector 65 has a length substantially equal to the length of the relay board 70. The mounting connector 65 has contacts 65*b* (FIG. 7) arranged in an insulating main body part 65*a* with such a disposition as to enable differential transmission. The mounting connector 65 is a right-angle type, and is mounted on a printed board in a position parallel thereto. The number of contacts 65*b* is equal to the total number of contacts 63-1*b* through 63-4*b* of the I/O connector sockets 63-1 through 63-4. The mounting connector 65 is surface-mounted on the mounting connector mounting part 75, being positioned with the projections (not graphically illustrated) of the main body part 65*a* fitted into the positioning holes 75*b* and having the contacts 65*b* soldered to the pads 75*a*.

The mounting connector 65 has a socket part 65*c* facing toward the Z2 side. The mounting connector 65 further includes a guide projection part 65*d* facing toward the Z2 side at each longitudinal end of the main body part 65*a*.

[Holder Member 62]

Figure 14:
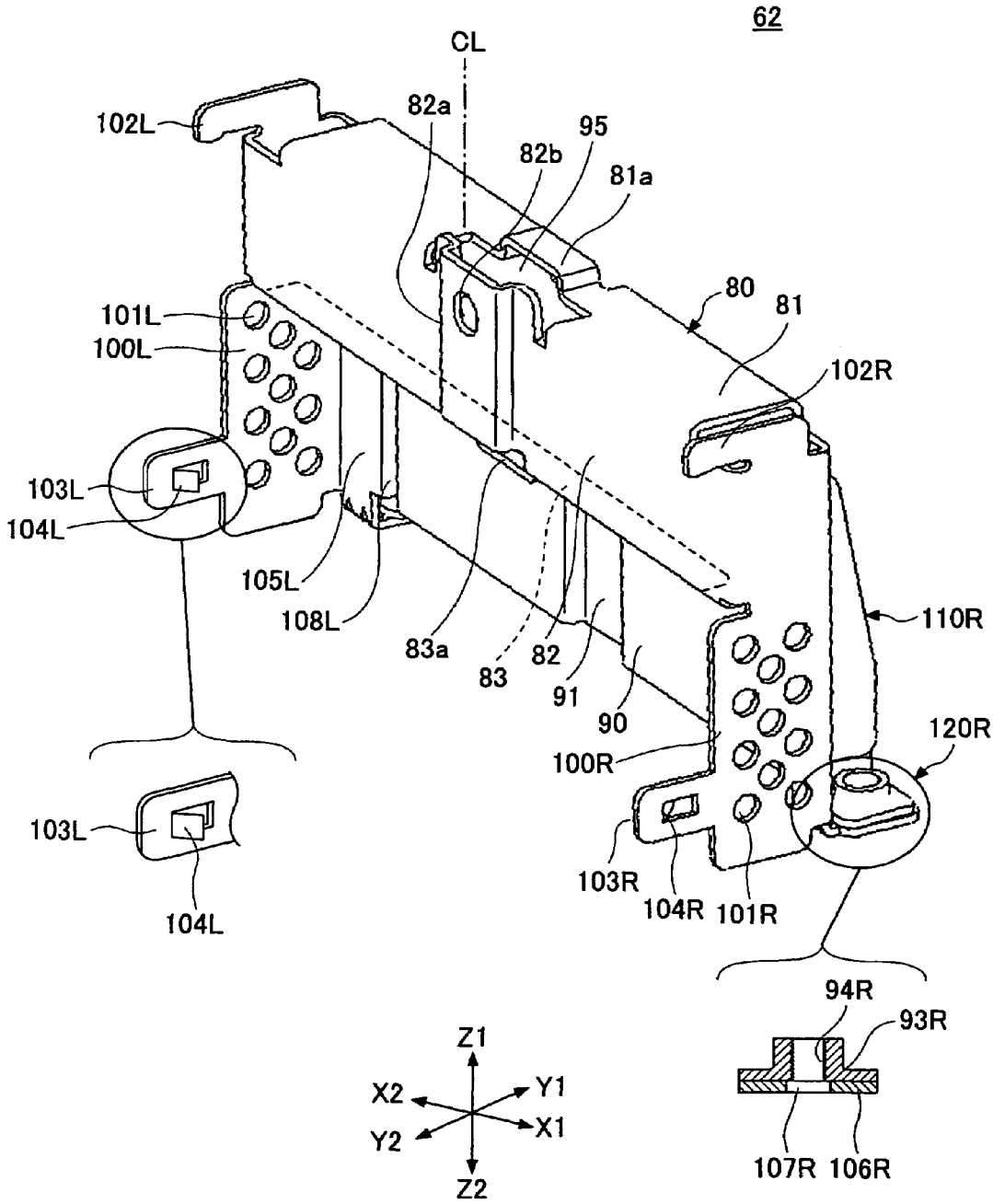
FIG. 14 is a front perspective view of the holder member according to the first embodiment of the present invention.
Figure 15:
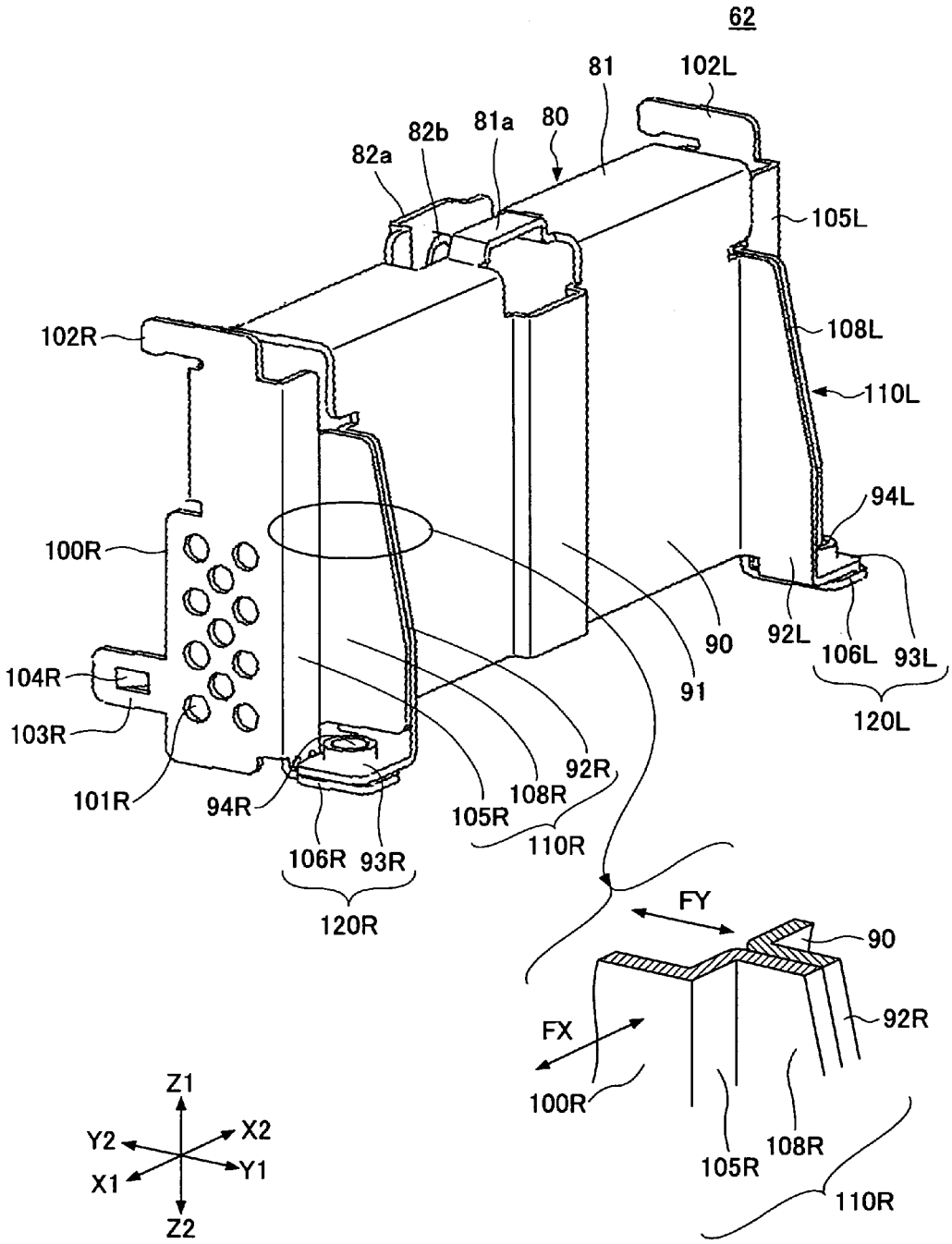
FIG. 15 is a rear perspective view of the holder member according to the first embodiment of the present invention.

FIGS. 14 and 15 are a front perspective view and a rear perspective view, respectively, of the holder member 62.

Referring to FIGS. 14 and 15, the holder member 62 has a symmetric shape with respect to the Y-Z plane including a center line CL passing through the X-axial center (the center in the X1-X2 direction) so as to extend along the Y-axis. Viewing from the Y2 (front) side, an element of the holder member 62 on the right side is referred to by a reference numeral with a subscript R, and an element of the holder member 62 on the left side is referred to by a reference numeral with a subscript L.

Figure 16:
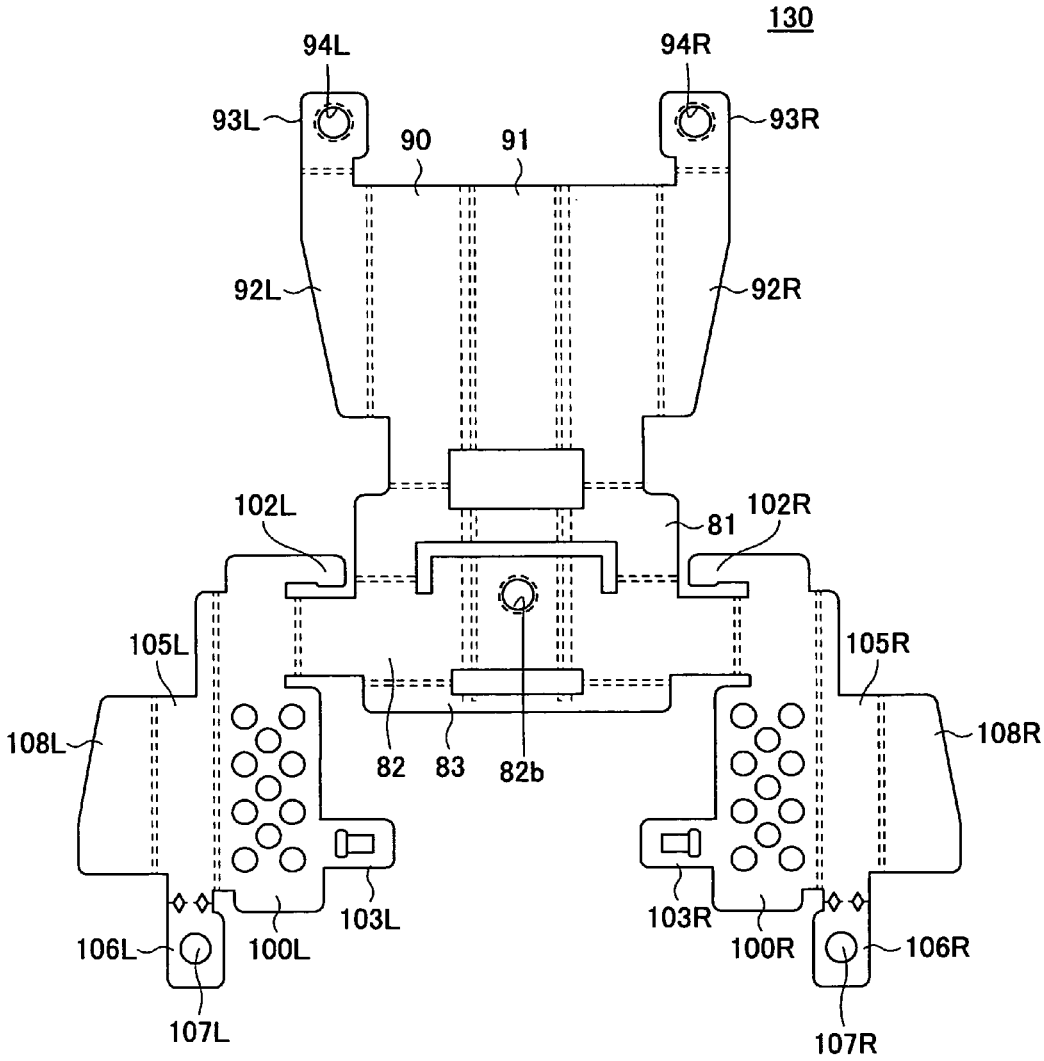
FIG. 16 is a plan view of a metal plate member from which the holder member is formed according to the first embodiment of the present invention.

The holder member 62 is manufactured by bending a metal plate member 130 of a shape shown in FIG. 16 as shown in FIGS. 17 through 20. The holder member 62 includes a right side plate part 100R, a left side plate part 100L, a hollow beam part 80 provided laterally between the side plate parts 100R and 100L, a rear plate part 90 extending from the hollow beam part 80, leg structure parts 110R and 110L, and foot structure parts 120R and 120L. The leg structure part 110R is formed by combining an extending part of the side plate part 100R and an extending part of the rear plate part 90. The leg structure part 110L is formed by combining an extending part of the side plate part 100L and an extending part of the rear plate part 90. The foot structure part 120R, which has a stack structure, is positioned at the lower end of the leg structure part 110R. The foot structure part 120L, which has a stack structure, is positioned at the lower end of the leg structure part 110L.

The hollow beam part 80, the leg structure parts 110R and 110L, the foot structure parts 120R and 120L (the structure of screwing the foot structure parts 120R and 120L), the crank shapes of the side plate parts 100R and 100L, and a rib part 82*a* formed by being cut and raised increase the strength of the holder member 62 to substantially the same level as that of a die-cast one. In addition, since the holder member 62 is manufactured by bending the metal plate member 130, the holder member 62 is lighter in weight, smaller in outside dimensions, and lower in manufacturing cost than a die-cast one.

Referring to FIG. 14, the hollow beam part 80 extends along the X-axis. The hollow beam part 80 is made up of a Z1-side part of the rear plate part 90, a top plate part 81 projecting in the Y2 direction from the Z1 end of the rear plate part 90, a front plate part 82 bent in the Z2 (downward) direction from the Y2 end (front end) of the top plate part 81, and a bent-back plate part 83 bent in the Y1 (rear) direction from the Z2 (lower) end of the front plate part 82. The hollow beam part 80 is a hollow beam having a substantially quadrangular (for example, square) cross section.

The top plate part 81 has a bridge part 81*a* formed in the center part thereof, the bridge part 81*a* being cut and raised to extend along the X-axis. The bent-back plate part 83 has a bridge part 83*a* formed in the center part thereof, the bridge part 83*a* being cut and raised to extend along the X-axis. The front plate part 82 has the rib part 82*a* for reinforcement in the center part thereof, the rib part 82*a* being cut and raised to extend along the Z-axis. The hollow beam part 80 is reinforced by the rib part 82*a* and the bridge parts 81*a* and 83*a*.

A screw hole 82*b* is formed in the rib part 82*a*. Further, the top plate part 81 has a vent opening 95 formed next to the bridge part 81*a*.

Referring to FIG. 15, the rear plate part 90 forms the rear face of the holder member 62. The rear plate part 90 has a rib part 91 for reinforcement formed in the center part thereof, the rib part 91 being cut and raised to extend along the Z-axis.

The rear plate part 90 includes a leg part (rear-plate-side leg part) 92R and an upper foot part 93R on the X1 side. The leg part 92R is bent to extend in the Y1 (sideward) direction. The upper foot part 93R is bent from the Z2 end of the leg part 92R so as to face (extend) toward the X1 direction. The upper foot part 93R has a screw hole 94R. The rear plate part 90 includes a leg part (rear-plate-side leg part) 92L and an upper foot part 93L with a screw hole 94L on the X2 side. Like the side plate parts 100R and 100L, the rear plate part 90 may have multiple vent holes provided therein.

Referring to FIGS. 14 and 15, the side plate part 100R is formed by being bent from the X1 end of the front plate part 82 of the hollow beam part 80. The side plate part 100R has multiple vent holes 101R, an upper lug 102R projecting in the Y2 direction in a Z1-side part, and a lower lug 103R projecting in the Y2 direction in a Z2-side part. A cut and raised engagement piece 104R (FIG. 11) whose free end is on the Y1 side is formed on the lower lug 103R.

Referring to FIG. 15, a leg part (side-plate-side leg part) 105R, a lower foot part 106R, and a bracket part 108R are provided on the Y1 side of the side plate part 100R. The leg part 105R is formed by being bent in the X2 (sideward) direction from the side plate part 100R. The lower foot part 106R is bent from the Z2 end of the leg part 105R so as to face (extend) toward the Y1 direction. The bracket part 108R is formed by bending the X2 side of the leg part 105R in the Y1 direction. A hole 107R through which a screw passes is formed in the lower foot part 106R.

The leg part (rear-plate-side leg part) 92R and the leg part (side-plate-side leg part) 105R are disposed to form a right angle when viewed from the Z2 direction. The bracket part 108R is positioned on the X1 side of the leg part 92R so as to be superposed on the leg part 92R. The leg part 92R, the leg part 105R, and the bracket part 108R form the composite leg structure part 110R. The leg part 92R and the leg part 105R are disposed at right angles to each other. The leg part 92R is disposed so that its width extends along the Y-axis, and the leg part 105R is disposed so that its width extends along the X-axis. Accordingly, a force FY along the Y-axis exerted on the hollow beam part 80 is received by the leg part 92R, and a force FX along the X-axis exerted on the hollow beam part 80 is received by the leg part 105R, so that the leg structure part 110R has high mechanical strength.

The lower foot part 106R and the upper foot part 93R are vertically superposed so as to form the foot structure part 120R, so that the foot structure part 120R has high mechanical strength.

Referring to FIGS. 14 and 15, the side plate part 100L is formed by being bent from the X2 end of the front plate part 82 of the hollow beam part 80. The side plate part 100L has multiple vent holes 101L, an upper lug 102L projecting in the Y2 direction in a Z1-side part, and a lower lug 103L projecting in the Y2 direction in a Z2-side part. A cut and raised engagement piece 104L (FIG. 11) is formed on the lower lug 103L.

Referring to FIG. 15, a leg part (side-plate-side leg part) 105L, a lower foot part 106L, and a bracket part 108L are provided on the Y1 side of the side plate part 100L. The leg part 105L is formed by being bent in the X1 (sideward) direction from the side plate part 100L. The lower foot part 106L is bent from the Z2 end of the leg part 105L so as to face (extend) toward the Y1 direction. The bracket part 108L is formed by bending the X1 side of the leg part 105L in the Y1 direction. A hole 107L through which a screw passes is formed in the lower foot part 106L.

The leg part (rear-plate-side leg part) 92L and the leg part (side-plate-side leg part) 105L are disposed to form a right angle when viewed from the Z2 direction. The bracket part 108L is positioned on the X2 side of the leg part 92L so as to be superposed on the leg part 92L. The leg part 92L, the leg part 105L, and the bracket part 108L form the composite leg structure part 110L. The leg part 92L and the leg part 105L are disposed at right angles to each other. The leg part 92L is disposed so that its width extends along the Y-axis, and the leg part 105L is disposed so that its width extends along the X-axis. Accordingly, a force FY along the Y-axis exerted on the hollow beam part 80 is received by the leg part 92L, and a force FX along the X-axis exerted on the hollow beam part 80 is received by the leg part 105L, so that the leg structure part 110L has high mechanical strength.

The lower foot part 106L and the upper foot part 93L are vertically superposed so as to form the foot structure part 120L, so that the foot structure part 120L has high mechanical strength.

The metal plate member 130 of FIG. 16 is in a planar state before bending, that is, shows the holder member 62 at the beginning of development. Each sectional part is referred to by the reference numeral of a corresponding part of the holder member 62. Broken lines are bending lines along which the metal plate member 130 is to be suitably bent outward or inward.

The metal plate member 130 is bent, for example, in the following sequence.

Figure 17:
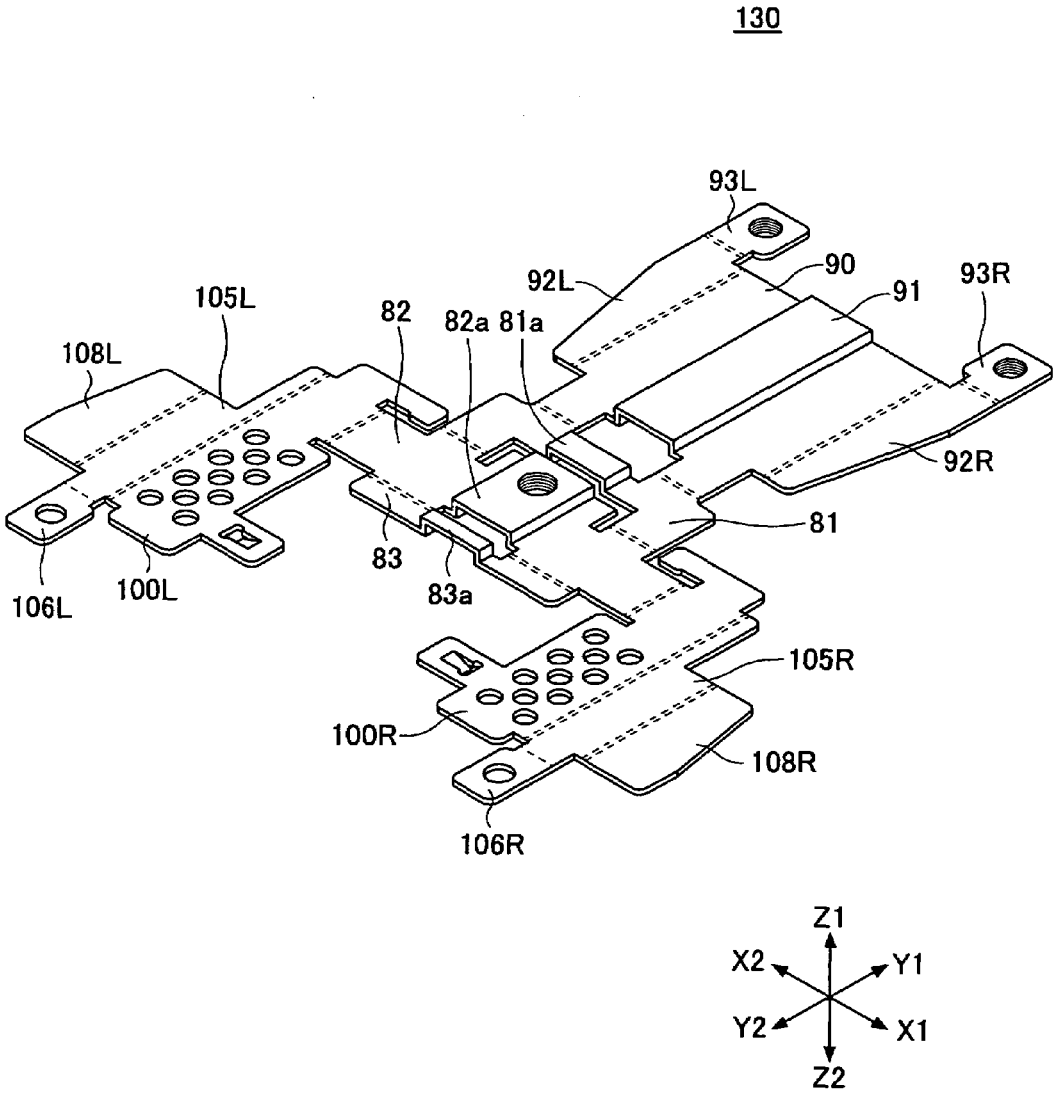
FIG. 17 is a perspective view of the metal plate member having part thereof bent according to the first embodiment of the present invention.
Figure 18:
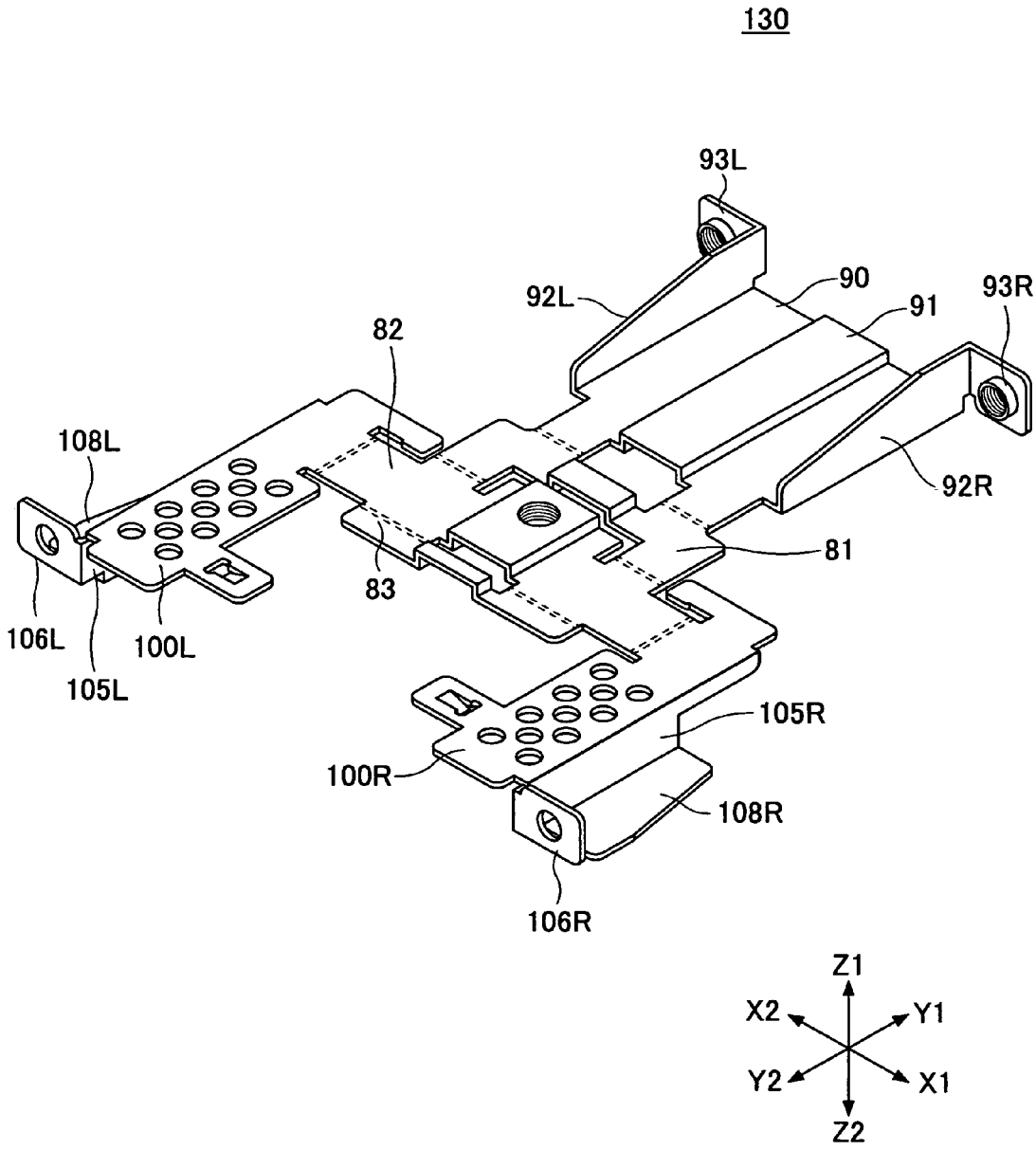
FIG. 18 is a perspective view of the metal plate member having another part thereof bent according to the first embodiment of the present invention.

First, as shown in FIG. 17, the bridge part 83*a*, the rib part 82*a*, the bridge part 81*a*, and the rib part 91 are formed to be arranged on a straight line. Further, as shown in FIG. 18, the leg part 105R, the lower foot part 106R, and the bracket part 108R are formed by bending corresponding parts extending from the side plate part 100R, and the leg part 105L, the lower foot part 106L, and the bracket part 108L are formed by bending corresponding parts extending from the side plate part 100L. Further, the leg parts 92R and 92L and the upper foot parts 93R and 93L are formed by bending corresponding parts extending from both sides of the rear plate part 90.

Figure 19:
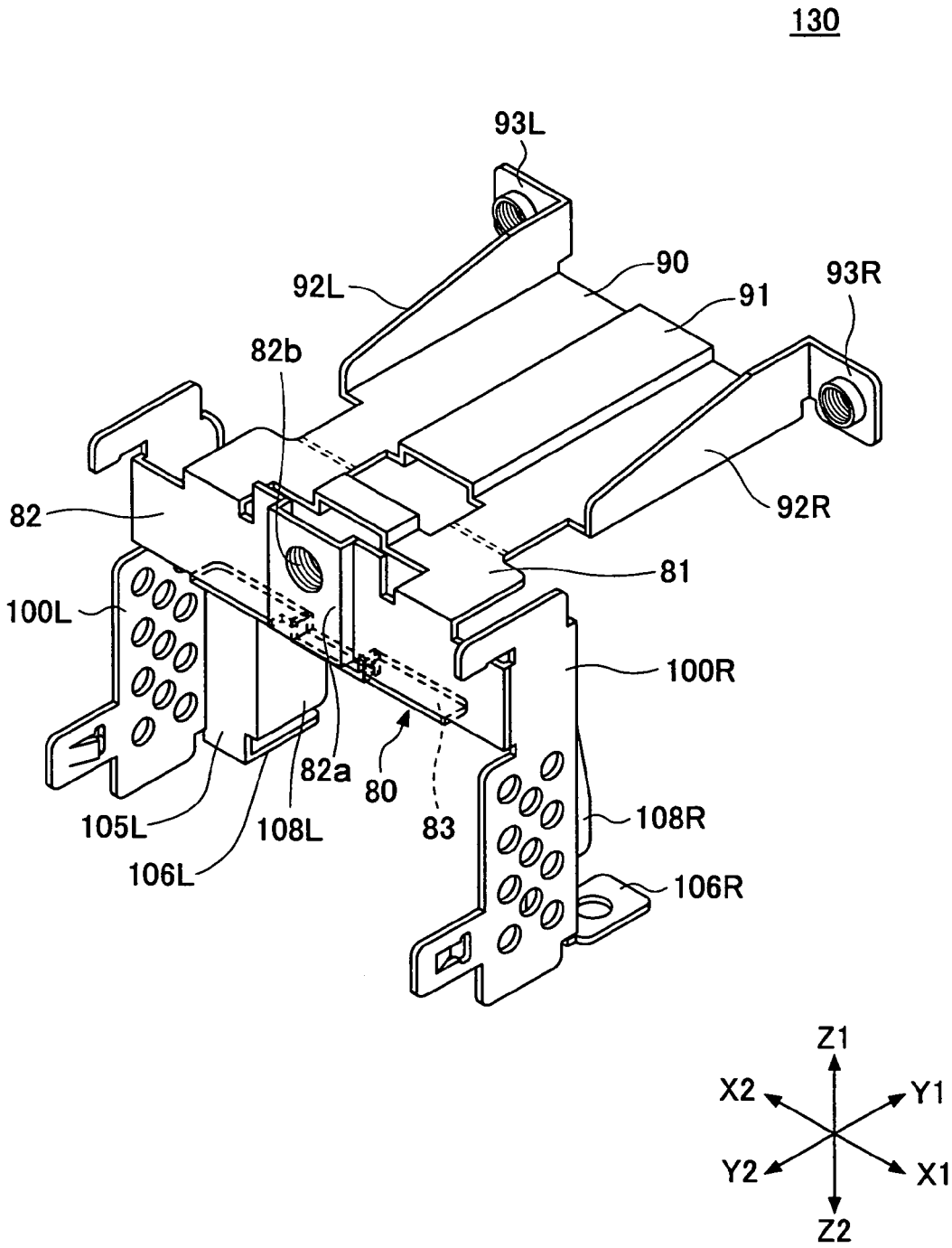
FIG. 19 is a perspective view of the metal plate member further bent in the process of manufacturing according to the first embodiment of the present invention.
Figure 20:
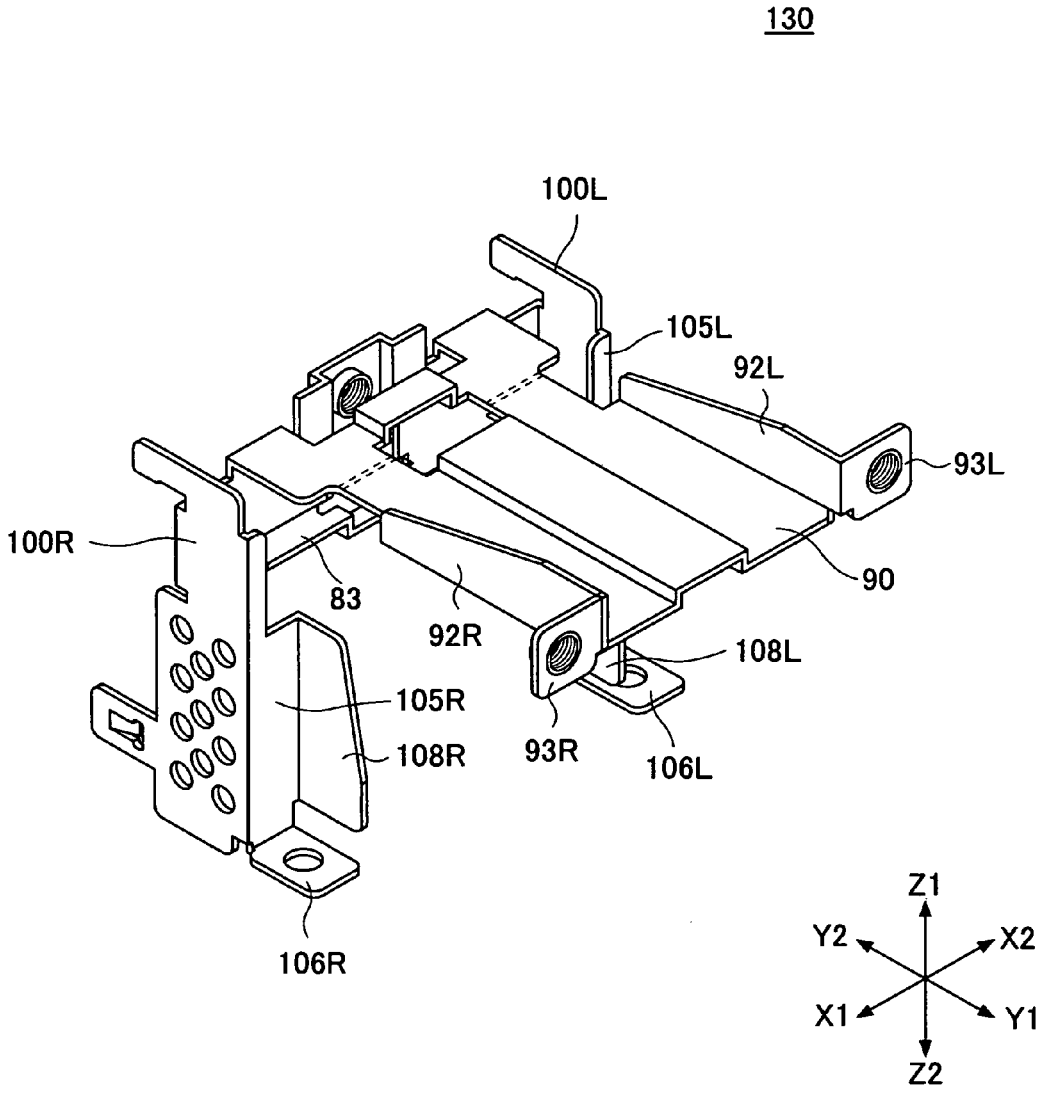
FIG. 20 is a perspective view of the metal plate member in the process of manufacturing of FIG. 19 from a different direction according to the first embodiment of the present invention.

Next, as shown in FIGS. 19 and 20, the hollow beam part 80 is formed by bending the bent-back plate part 83 and the front plate part 82, and each of the side plate parts 100R and 100L is formed by bending a corresponding part extending sideward from the front plate part 82.

Finally, a part extending in the Y1 direction from the hollow beam part 80 is bent in the Z2 direction. As a result of this bending, the rear plate part 90 is formed between the side plate part 100R and the side plate part 100L as shown in FIGS. 14 and 15. Further, the leg part 92R is superposed on the bracket part 108R, so that the composite leg structure part 110R is formed in proximity to the leg part 105R, being positioned perpendicularly thereto. Further, the upper foot part 93R is on top of the lower foot part 106R so as to form the foot structure part 120R. Further, the leg part 92L is superposed on the bracket part 108L, so that the composite leg structure part 110L is formed in proximity to the leg part 105L, being positioned perpendicularly thereto. Further, the upper foot part 93L is on top of the lower foot part 106L so as to form the foot structure part 120L.

[Connector Socket Module 60]

As shown in FIGS. 3, 11, and 12, the connector socket module 60 has the holder member 62 attached to the rear side of the connector socket module main body 61 with the special shaped screw member 67.

The holder member 62 covers the rear side of the connector socket module main body 61 and is temporarily fastened thereto with the upper lugs 102R and 102L engaging the cutout parts 76R and 76L, respectively, of the relay board 70 and the lower lugs 103R and 103L fitted to the cutout parts 77R and 77L, respectively, of the relay board 70. In this condition, the special shaped screw member 67 is tightened from the front side of the connector socket module main body 61, and the cut and raised engagement pieces 104R and 104L are plastically deformed by being bent in directions to be pulled down so that the respective ends of the engagement pieces 104R and 104L come into contact with the front face 70*a* of the relay board 70 so as to be engaged therewith. Thereby, the connector socket module main body 61 and the holder member 62 are integrated. The holder member 62 covers the rear face 70*b* of the relay board 70 and the mounting connector 65, and holds the connector socket module main body 61.

The connector socket module main body 61 is joined to the holder member 62 at three points apart from one another. That is, the connector socket module main body 61 has its part at an upper center position fixed to the rib part 82*a* in the center of the hollow beam part 80 with the special shaped screw member 67, and has its lower right and left sides fixed to the holder member 62 with parts of the lower lugs 103R and 103L, that is, the engagement pieces 104R and 104L plastically deformed by being bent in directions to be flattened.

Further, the movement of the connector socket module main body 61 along the X-axis relative to the holder member 62 is restricted by the lower lugs 103R and 103L. The movement of the connector socket module main body 61 in the Z1 direction relative to the holder member 62 is restricted by the upper lugs 102R and 102L.

As shown enlarged in FIG. 11, the engagement pieces 104R and 104L are raised at an angle of 45° to the lower lugs 103R and 103L, respectively, and are bent to form an angle of approximately 20° with the lower lugs 103R and 103L, respectively, so as to engage and secure the front face 70*a* of the relay board 70.

Figure 21A:
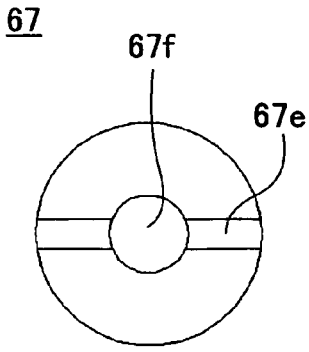
FIGS. 21A through 21C are diagrams showing a special shaped screw member according to the first embodiment of the present invention.
Figure 21B:
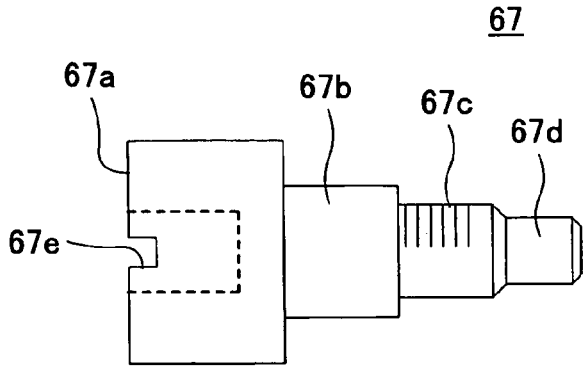
Figure 21C:
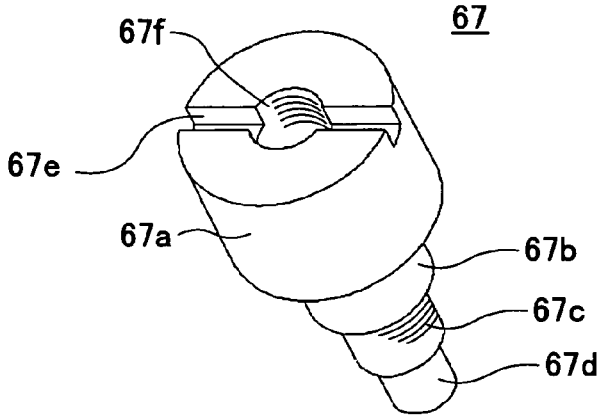

FIGS. 21A through 21C are diagrams showing the special shaped screw member 67.

Referring to FIGS. 21A through 21C, the special shaped screw member 67 includes a screw head part 67*a*, a shaft part 67*b*, an external thread part 67*c*, and an end guide part 67*d*. A slit 67*e* and an internal thread part 67*f* are formed in the screw head part 67*a*. The tip of a screwdriver is fitted into the slit 67*e*. The internal thread part 67*f* is formed in a hole formed from the top face of the screw head part 67*a* in the center thereof.

Referring to FIG. 12, the special shaped screw member 67 is fixed with the shaft part 67*b* fitted into the through hole 78 and the external thread part 67*c* screwed into the screw hole 82*b*. The screw head part 67*a* is positioned between the I/O connector sockets 63-3 and 63-4. The height (Y1-Y2 dimension) of the screw head part 67*a* corresponds to the height (Y1-Y2 dimension) of the base part of each of the insulating main body parts 63-1*a* through 63-4*a* of the I/O connector sockets 63-1 through 63-4 (see FIG. 11). The special shaped screw member 67 is inserted into the through hole 78 of the relay board 70 between the I/O connector sockets 63-3 and 63-4, and the end guide part 67*d* enters the screw hole 82*b* so that the position of the end of the special shaped screw member 67 is determined. Accordingly, it is easy to tighten the special shaped screw member 67.

[Structure of the Mounting of the Connector Socket Module 60 on the Main Board 53 of the Server 50]

Referring to FIG. 3, the main-board-side connector 54 is mounted on the main board 53. Through holes 55 and 56 (FIG. 10) are formed near the main-board-side connector 54 in the main board 53.

As shown in FIGS. 4 and 10, the connector socket module 60 of FIG. 3 is mounted on the main board 53 with the mounting connector 65 fitted and connected to the main-board-side connector 54 and the foot structure parts 120R and 120L fixed to the main board 53 with the screws 57 and 58 inserted from the lower side of the main board 53. The guide projection parts 65*d* are fitted into corresponding guide hole parts 54*a* (FIG. 3), so that the mounting connector 65 is smoothly fitted and connected to the main-board-side connector 54.

Here, as shown enlarged in part of FIG. 10, the screw 57 is screwed into the screw hole 94R of the upper foot part 93R through the hole 107R of the lower foot part 106R. The foot structure part 120R has the lower foot part 106R sandwiched between the main board 53 and the upper foot part 93R. Likewise, the foot structure part 120L has the lower foot part 106L sandwiched between the main board 53 and the upper foot part 93L. Accordingly, the foot structure parts 120R and 120L are firmly fixed to the main board 53. Further, both the leg part 92R and the leg part 105R are firmly fixed so as to form the strong leg structure part 10R, and both the leg part 92L and the leg part 105L are firmly fixed so as to form the strong leg structure part 110L. Thus, the holder member 62 is not easily deformed even if an external force is exerted thereon, and is fixed to the main board 53 in this condition. Accordingly, the connector socket module 60 is firmly fixed and mounted on the main board 53.

The connector socket module 60 mounted on the main board 53 is also fixed to the front panel 51 of the server 50. That is, as shown in FIGS. 4 and 7, the screw 59 is screwed into the internal thread part 67*f* of the screw head part 67*a* of the special shaped screw member 67 through a hole 51*a* of the front panel 51, so that the connector socket module 60 is fixed to the front panel 51 at the position of the special shaped screw member 67 (which is part of the connector socket module 60 remote from where the connector socket module 60 is fixed to the main board 53). Accordingly, the connector socket module 60 is firmly fixed to the server 50. As a result, connection and disconnection of the cable-side connector plug 40 are performed with stability.

Multiple connector socket modules 60 may be prepared in advance, and be provided on and screwed to the main board 53. Thereby, it is possible to form a disposition where the connector socket modules 60 are arranged in two rows.

If one of the I/O connector sockets 63-1 through 63-4 fails while the server 50 is in use, it is sufficient to replace the I/O connector socket module 60 having the failed one of the I/O connector sockets 63-1 through 63-4, and there is no need to replace the main board 53, thus facilitating maintenance.

Further, the holder member 62 forms part of a ground path. That is, the ground pattern of the main board 53 is electrically connected to the front panel 51 through the screw 59, the holder member 62, and the special shaped screw member 67. Further, the ground pattern of the relay board 70 is electrically connected to the front panel 51 through the special shaped screw member 67.

With the server 50 being attached to a rack and in operation, the ground pattern of the main board 53 is grounded through the screw 59, the holder member 62, the special shaped screw member 67, the front panel 51, and the rack. The ground pattern of the relay board 70 is grounded through the special shaped screw member 67, the front panel 51, and the rack.

With the server 50 being attached to a rack and in operation, airflow generated in the server 50 for forced air cooling enters the holder member 62 through the vent holes 101R and 101L and the vent opening 95 so as to go out of the holder member 62. As a result, the rear side part of the relay board 70 of the connector socket module main body 61 is effectively air-cooled.

Figure 22A:
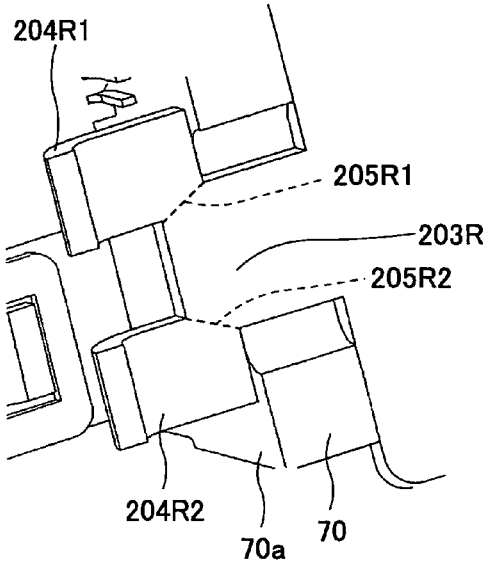
FIGS. 22A through 22D are diagrams showing a variation of a cut and raised engagement piece according to the first embodiment of the present invention.
Figure 22B:
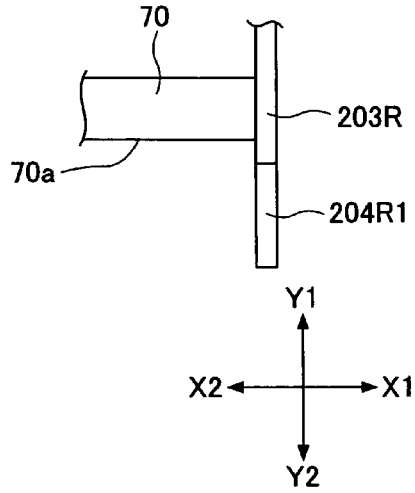

FIGS. 22A through 22D show a variation of the cut and raised engagement piece 104R. FIGS. 22A and 22B show an initial state. Engagement pieces 204R1 and 204R2 extend in the Z1 and Z2 directions, respectively, from a lower lug 203R. A boundary 205R1 between the engagement piece 204R1 and the lower lug 203R and a boundary 205R2 between the engagement piece 204R2 and the lower lug 203R are inclined so that the distance therebetween is reduced toward the Y2 direction (an end part of the lower lug 203R defined by the boundaries 205R1 and 205R2 is tapered toward the Y2 direction).

Figure 22C:
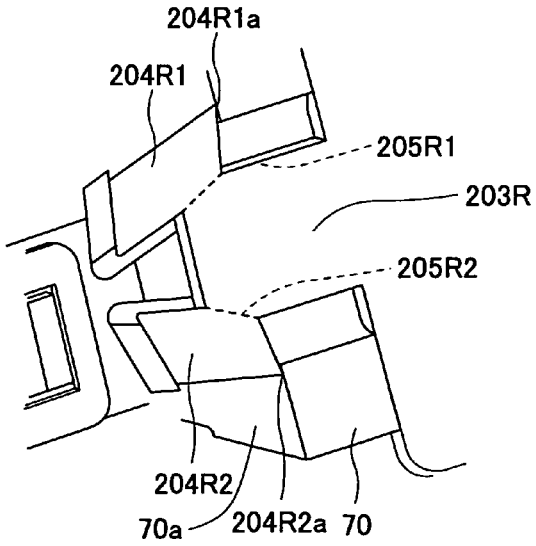
Figure 22D:
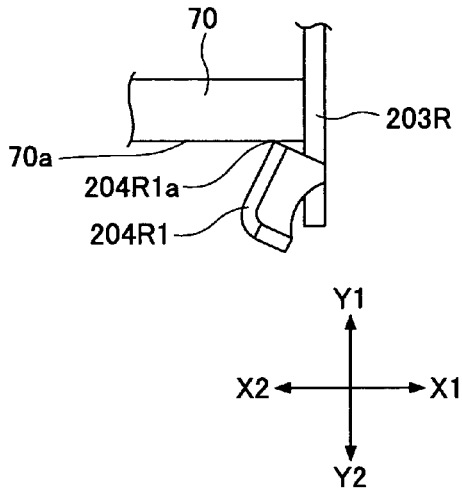

The engagement pieces 204R1 and 204R2 are plastically deformed by being bent at the boundaries 205R1 and 205R2, respectively, toward the center of the connector socket module 60. As a result, the engagement pieces 204R1 and 204R2 are as shown in FIGS. 22C and 22D. That is, a corner 204R1*a* of the engagement piece 204R1 and a corner 204R2*a* of the engagement piece 204R2 come closer to the front face 70*a* of the relay board 70 so as to engage and secure the relay board 70.

Second Embodiment

Figure 23:
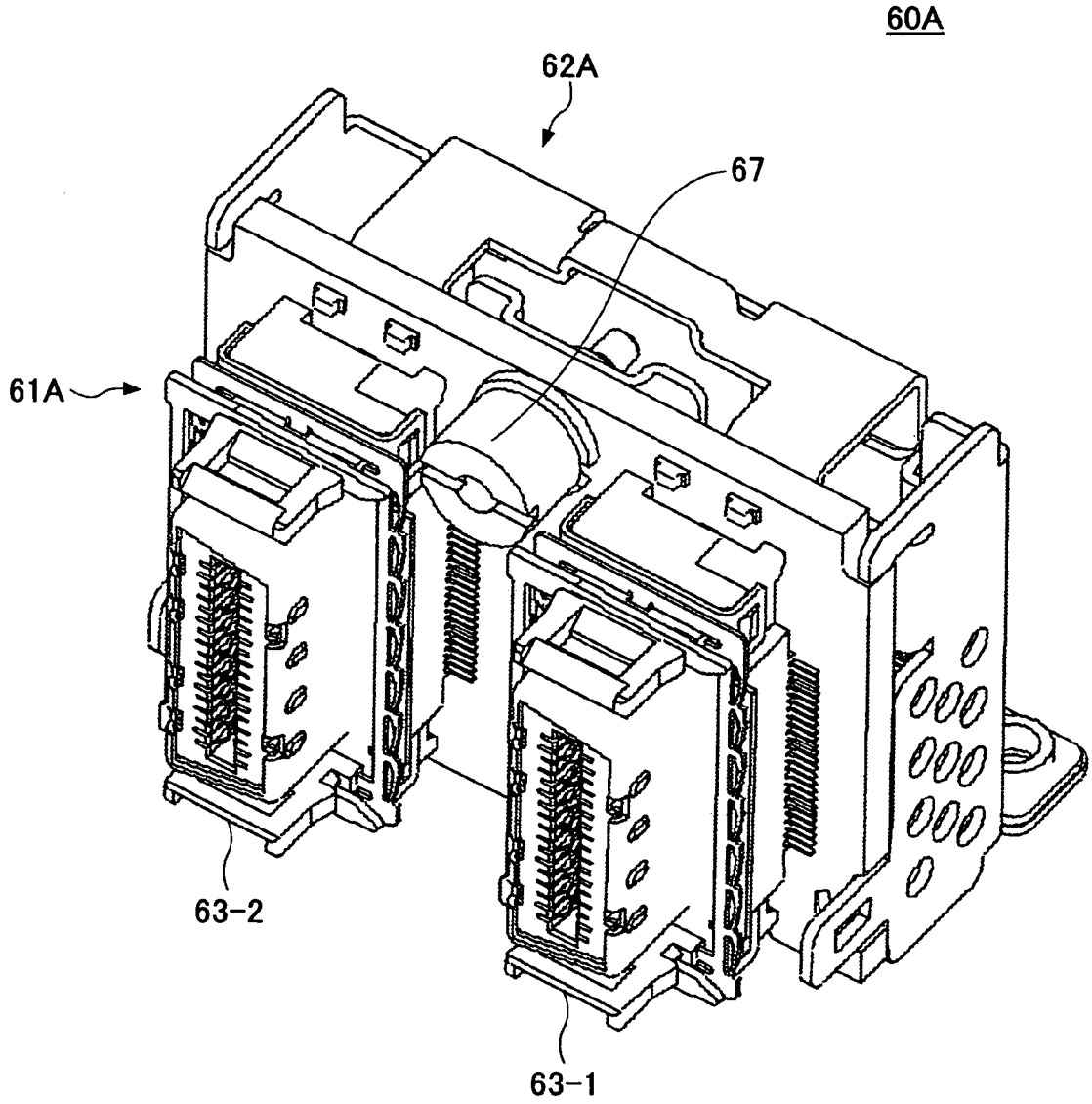
FIG. 23 is a perspective view of a connector socket module according to a second embodiment of the present invention.
Figure 24:
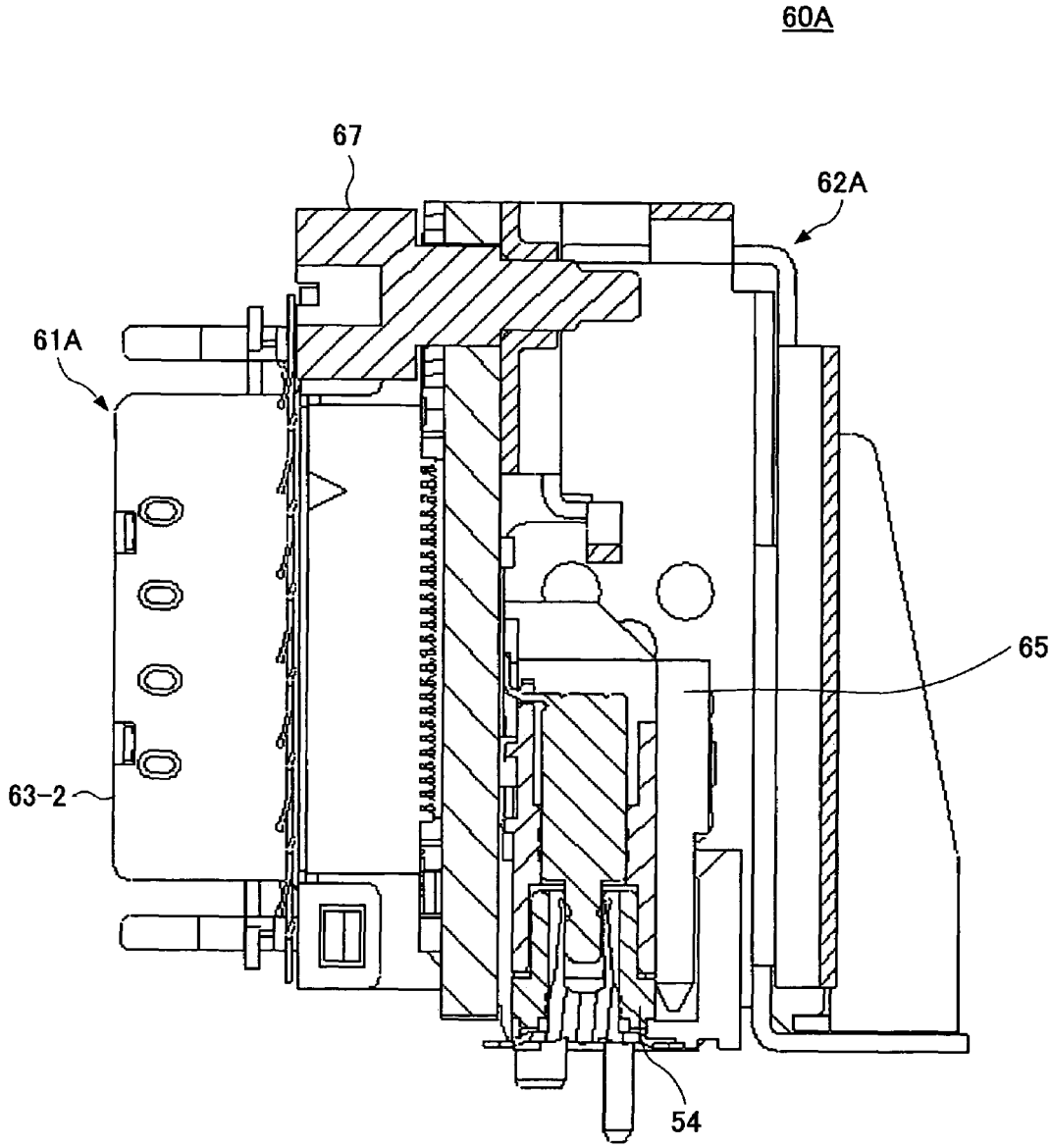
FIG. 24 is a cross-sectional view of the connector socket module according to the second embodiment of the present invention.

FIGS. 23 and 24 are diagrams showing a connector socket module 60A according to a second embodiment of the present invention. The connector socket module 60A includes a connector socket module main body 61A and a holder member 62A fixed to each other. The connector socket module 60A is different from the connector socket module 60 of the first embodiment in the number and the orientation of I/O connector sockets.

The connector socket module 60A has the two I/O connector sockets 63-1 and 63-2, which are oriented to be vertically long. The I/O connector sockets 63-1 and 63-2 are disposed horizontally in a single row and vertically in two rows.

I/O connector sockets may be disposed vertically in a single row and horizontally in two, three, or four rows.

Third Embodiment

Figure 25:
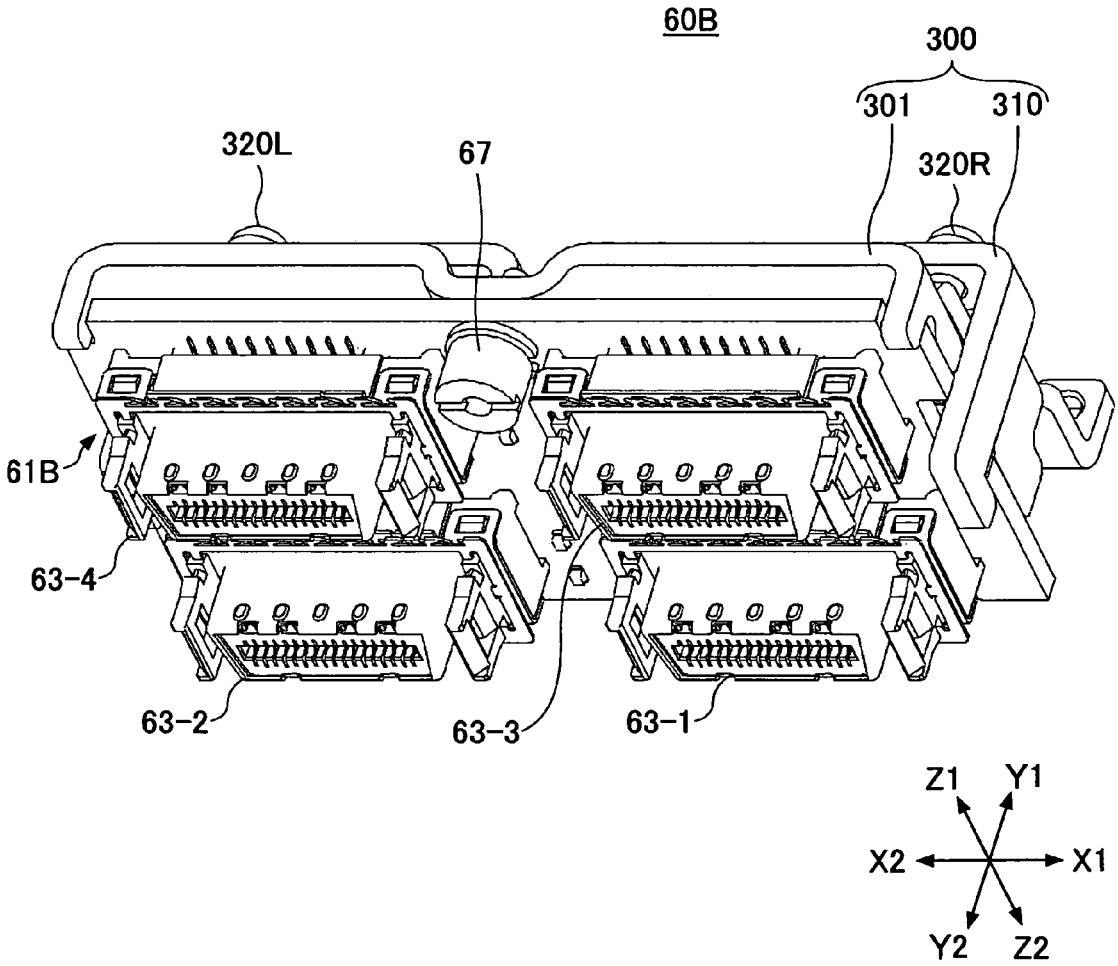
FIG. 25 is a perspective view of a connector socket module according to a third embodiment of the present invention.
Figure 26:
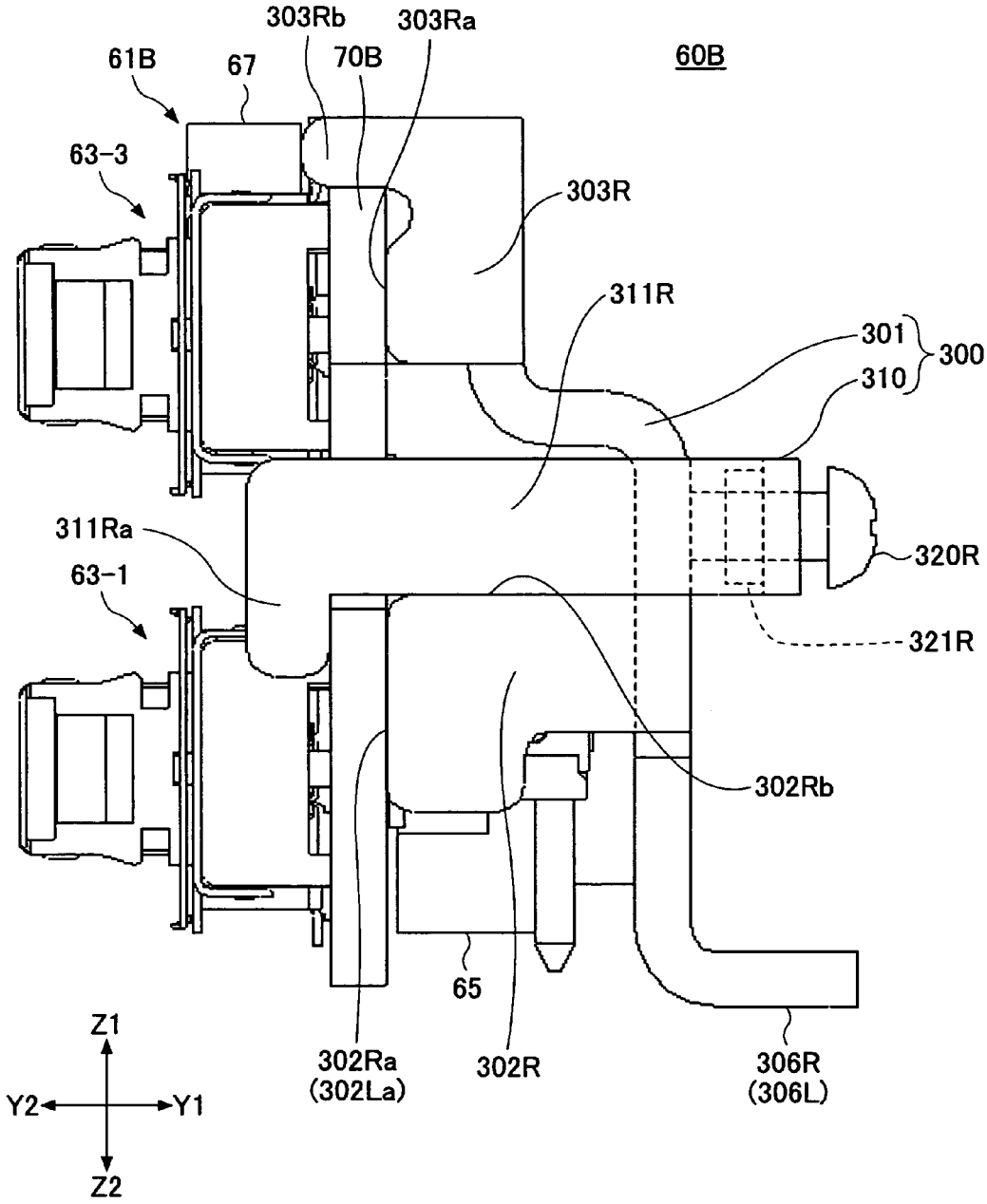
FIG. 26 is a side view of the connector socket module of FIG. 25 according to the third embodiment of the present invention.
Figure 27:
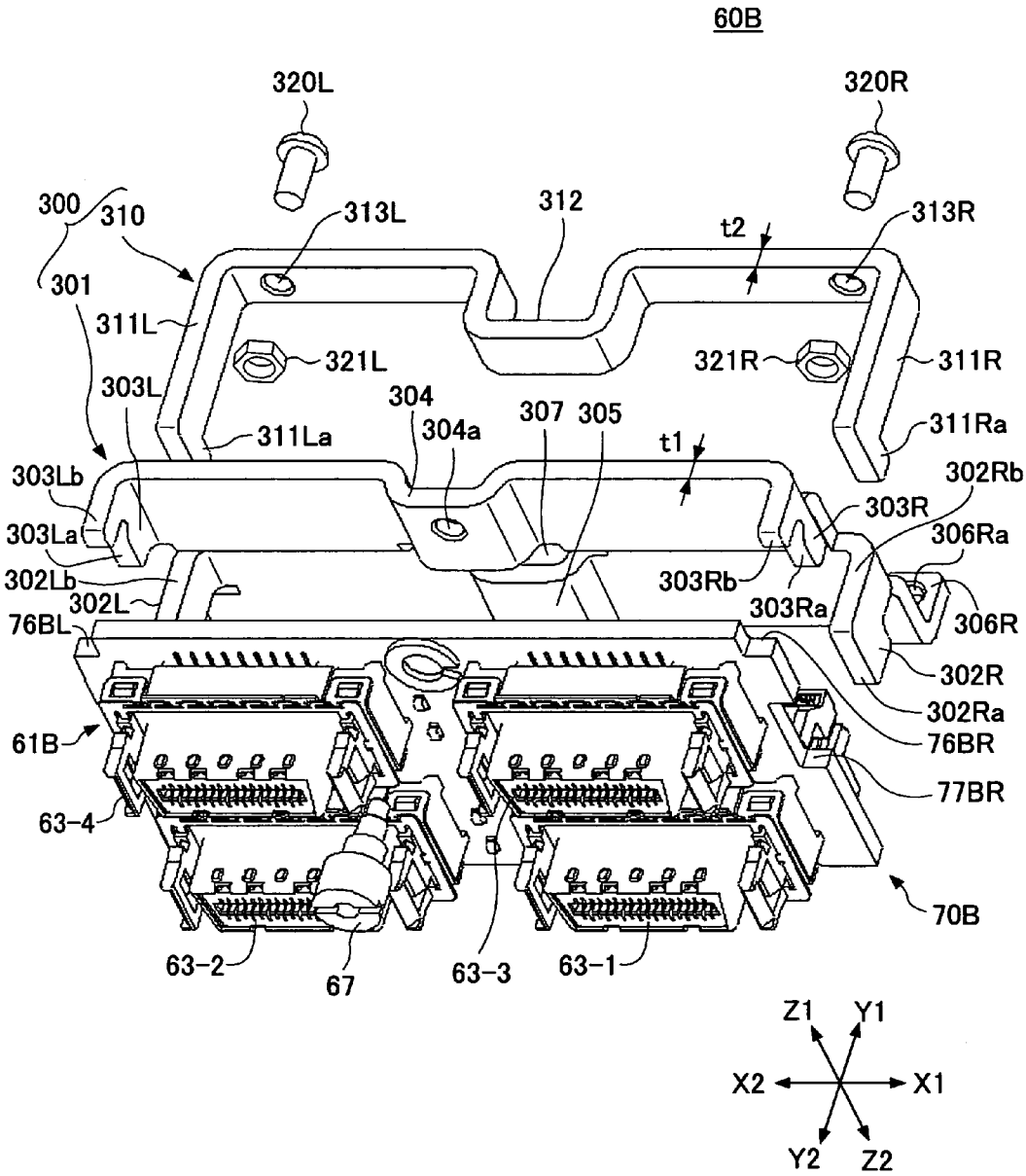
FIG. 27 is an exploded perspective view of the connector socket module of FIG. 25 according to the third embodiment of the present invention.
Figure 28:
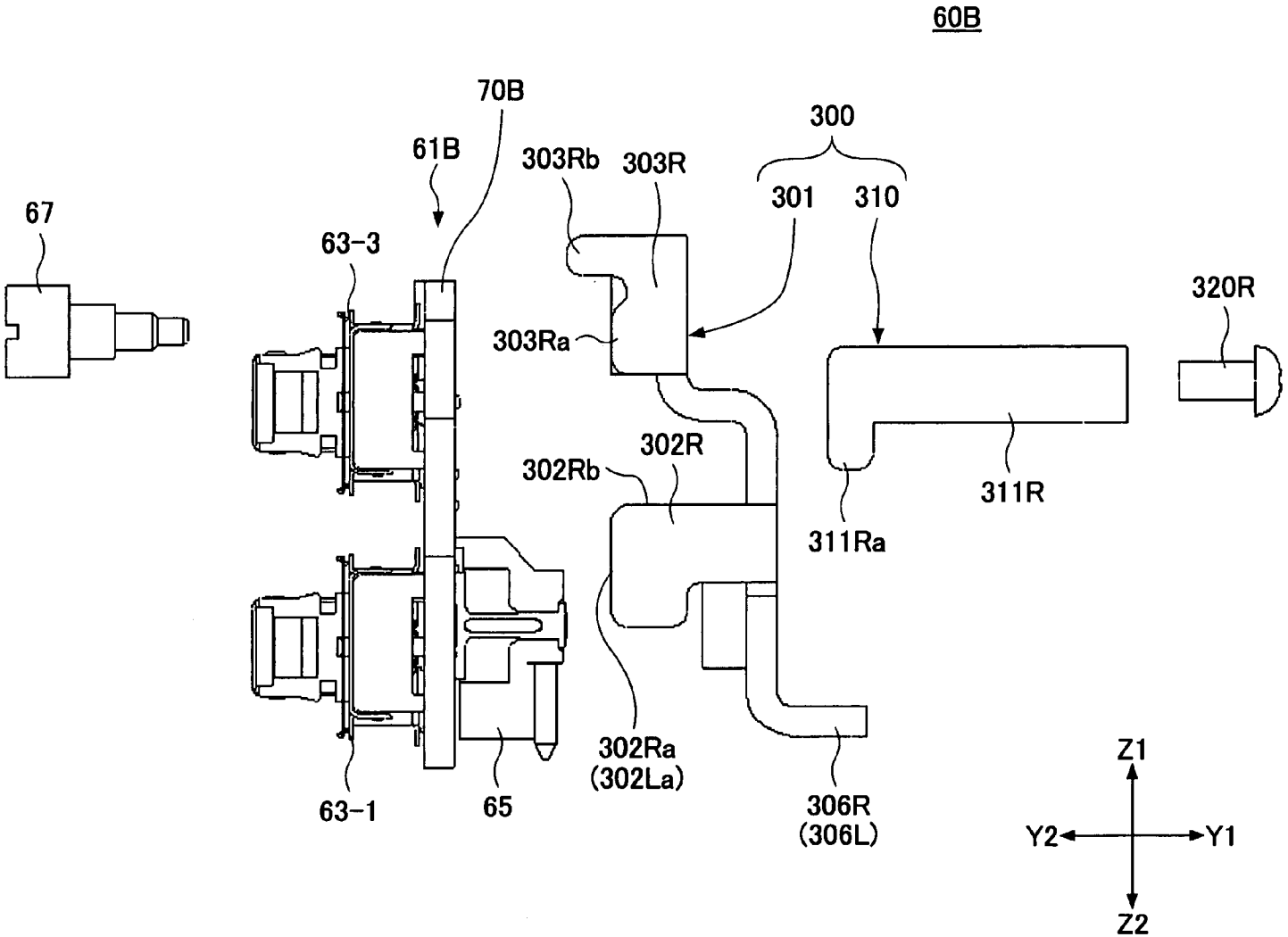
FIG. 28 is an exploded perspective view of the connector socket module of FIG. 26 according to the third embodiment of the present invention.

FIGS. 25 and 26 are diagrams showing a connector socket module 60B according to a third embodiment of the present invention. FIG. 27 is an exploded perspective view of the connector socket module 60B of FIG. 25. FIG. 28 is an exploded perspective view of the connector socket module 60B of FIG. 26.

The connector socket module 60B includes a holder structure 300, which is a difference from the connector socket module 60 of the first embodiment. In FIGS. 25 through 28, the elements corresponding to those shown in FIGS. 3 through 9 are referred to by the same reference numerals, and a description thereof is omitted.

The holder structure 300 is positioned on the rear side of a connector socket module main body 61B so as to hold the connector socket module main body 61B.

The connector socket module main body 61B includes a relay board 70B, which is a difference from the connector socket module main body 61 of the first embodiment shown in, for example, FIG. 8. The relay board 70B has cutout parts 76BR and 76BL formed in its upper (Z1-side) corners. Further, the relay board 70B has a cutout part 77BR and another cutout part (not graphically illustrated) formed at the X1 end and the X2 end, respectively, in the center thereof.

The holder structure 300 includes a first frame member 301, a second frame member 310, right and left screw members 320R and 320L, and right and left nuts 321R and 321L.

The holder structure 300 is symmetric with respect to the Y-Z plane passing through the X-axial center.

The first frame member 301 is a sheet metal member having a thickness t1 of 2 mm. The first frame member 301 includes arm parts 302R and 303R at the X1 end thereof and arm parts 302L and 303L at the X2 end thereof. The first frame member 301 further includes U-letter shaped parts 304 and 305 for reinforcement projecting in the Y2 direction in the center of the first frame member 301. The first frame member 301 has a substantially U-letter shape when viewed from the Z2 side. The first frame member 301 is shaped so as to extend over the rear side of the relay board 70B between the X1 end and the X2 end thereof. The first frame member 301 has rigidity. Further, the first frame member 301 has a foot part 306R and a foot part 306L (not graphically illustrated in FIGS. 25 and 27), which are fixed to the main board of the holder structure 300, at the lower right corner (Z2-X1 corner) and at the lower left corner (Z2-X2 corner), respectively, on the Y1 side. The first frame member 301 further includes an opening 307 in the center.

The arm parts 302R and 302L substantially in the Z-axial center of the first frame member 301 include relay board reception parts 302Ra and 302La, respectively, and second frame member support parts 302Rb and 302Lb, respectively. The relay board reception part 302La is not graphically illustrated in FIGS. 25 and 27.

The arm parts 303R and 303L on the Z1 side include relay board reception parts 303Ra and 303La, respectively, and lug parts 303Rb and 303Lb, respectively, projecting in the Y2 direction.

The foot part 306R, which is fixed to the main board of the holder structure 300, has a screw hole 306Ra. Likewise, the foot part 306L, which is fixed to the main board of the holder structure 300, has a screw hole (not graphically illustrated). The opening 307 receives a below-described U-letter shaped part 312 of the second frame member 310.

The second frame member 310 is a sheet metal member having a thickness t2 of 2 mm. The second frame member 310 includes arm parts 311R and 311L at the X1 end and the X2 end, respectively, thereof. The second frame member 310 has a substantially U-letter shape when viewed from the Z2 side, and is positioned on the Y1 side of the first frame member 301. The second frame member 310 is shaped so as to extend over the rear side of the relay board 70B between the X1 end and the X2 end thereof. The arm parts 311R and 311L have hook parts 311Ra and 311La at their respective ends. The second frame member 310 further includes a U-letter part 312 for reinforcement projecting in the Y2 direction in the center thereof, and has screw holes 313R and 313L on the X1 side and the X2 side, respectively.

Before combining the first frame member 301 and the second frame member 310, the screw members 320R and 320L are screwed into the screw holes 313R and 313L, respectively, and the nuts 321R and 321L are fitted around the screw members 320R and 320L, respectively.

The second frame member 310 with the screw members 320R and 320L is positioned on the Y1 side of the first frame member 301, and the U-letter part 312 is fitted into the opening 307, so that the first frame member 301 and the second frame member 310 are temporarily combined with the arm parts 311R and 311L being supported by the second frame member support parts 302Rb and 302Lb, respectively. Thereby, a temporary holder structure is formed.

The connector socket module main body 61B and the above-described temporary holder structure are combined as described below.

First, the connector socket module main body 61B and the temporary holder structure are temporarily combined, where the rear face of the relay board 70B opposes the relay board reception parts 302Ra and 303Ra on the X1-end side and the relay board reception parts 302La and 303La on the X2-end side with the hook parts 311Ra and 311La being fitted into the corresponding cutout parts (only the cutout part 77BR is shown) to engage and secure the front face of the relay board 70B, and the lug parts 303Rb and 303Lb engaging the cutout parts 76BR and 76BL, respectively.

Next, the screw members 320R and 320L on corresponding sides are tightened. The ends of the screw members 320R and 320L come into contact with the rear face of the first frame member 301 so as to displace the second frame member 310 in the Y1 direction. As a result, the X1 end part of the relay board 70B is held strongly between the hook part 311R and the relay board reception parts 302Ra and 303Ra, and the X2 end part of the relay board 70B is held strongly between the hook part 311L and the relay board reception parts 302La and 303La. Further, the first frame member 301 and the second frame member 310 are integrated into the holder structure 300. Further, the lug parts 303Rb and 303Lb restrict the displacement of the relay board 70B in the Z1 direction.

Next, the nuts 321R and 321L are tightened to be pressed against the opposing face of the second frame member 310 so as to lock the screw members 320R and 320L, respectively.

Finally, the special shaped screw member 67 is screwed into a screw hole 304*a* (FIG. 27) of the U-letter part 304 of the first frame member 301, thereby fixing the center of the relay board 70B to the U-letter part 304.

As a result, the holder structure 300 firmly holds the connector socket module main body 61B.

According to one aspect of the present invention, the number of main boards required can be reduced from the conventional two or more to one by employing connector socket modules according to the present invention, which modules are mounted and arranged on a main board. This makes it easy to design and assemble a server.

According to one aspect of the present invention, if one of the I/O connector sockets of connector socket modules according to the present invention fails, the connector socket module having the failed one of the I/O connector sockets may be removed and replaced with a new connector socket module. Thus, there is no need to replace the main board, so that it is easy to perform maintenance.

Further, according to one aspect of the present invention, since a holder member is formed by bending a metal plate member of a predetermined shape, a connector socket module can be reduced in size, weight, and manufacturing cost compared with the case of using a die-cast component as the holder member.

The present invention is not limited to the specifically disclosed embodiments, and variations and modifications may be made without departing from the scope of the present invention.

The present application is based on Japanese Priority Patent Applications No. 2006-066442, filed on Mar. 10, 2006, and No. 2006-125774, filed on Apr. 28, 2006, the entire contents of which are hereby incorporated by reference.

What is claimed is:

1. A connector socket module to be mounted on a main board so as to connect a cable-side connector plug and the main board, the connector socket module comprising:

a connector socket module main body; and a holder member configured to hold the connector socket module main body, wherein the connector socket module main body includes:

a relay board;

a plurality of I/O connector sockets of which a corresponding one is to be connected to the cable-side connector plug, the I/O connector sockets being arranged on a first face of the relay board; and a mounting connector to be connected to a connector on the main board, the mounting connector being mounted on a second face of the relay board, the second face facing away from the first face of the relay board; and the holder member covers a side of the connector socket module main body on a side of the second face of the relay board, is formed by bending a metal plate member of a predetermined shape, has a part to be fixed to the main board, and further comprises:

a first side plate part and a second side plate part on first and second opposing sides, respectively;

a hollow beam part extending between the first and second side plate parts;

a rear plate part extending in a direction of the main board from the hollow beam part;

a leg structure part formed by combining a first side-plate-side leg part extending from the first side plate and a first rear-plate-side leg part extending from the rear plate part and combining a second side-plate-side leg part extending from the second side plate and a second rear-plate-side leg part extending from the rear plate part, the first side-plate-side leg part and the second side-plate-side leg part extending toward each other, and the first rear-plate-side leg part and the second rear-plate-side leg part extending away from the connector socket module main body; and a foot structure part of a stack structure, the foot structure part being positioned at an end of the leg structure part on a side of the main board; and the relay board of the connector socket module main body is fixed to the hollow beam part of the holder member with a screw member.

2. The connector socket module as claimed in claim 1, wherein:

the hollow beam part of the holder member has a substantially quadrangular cross section and includes a front plate part having a screw hole; and the relay board of the connector socket module main body is fixed to the front plate part of the hollow beam part with the screw member being screwed into the screw hole of the front plate part through a hole in the relay board.

3. The connector socket module as claimed in claim 1, wherein:

the first side-plate-side leg part extends from the first side plate at a right angle thereto, and the second side-plate-side leg part extends from the second side plate at a right angle thereto;

the first and second rear-plate-side parts extend from the rear plate part at a right angle to the rear plate part; and the leg structure part has the first and second side-plate-side leg parts disposed at a right angle to the first and second rear-plate-side leg parts, respectively, when viewed in the direction of the main board.

4. The connector socket module as claimed in claim 3, wherein:

the leg structure part further includes a first bracket part and a second bracket part, the first bracket part extending from the first side-plate-side leg part at a right angle thereto, and the second bracket part extending from the second side-plate-side leg part at a right angle thereto; and the first and second bracket parts are superposed on the first and second rear-plate-side leg parts, respectively.

5. The connector socket module as claimed in claim 1, wherein:

the foot structure part comprises a first lower foot part having a first through hole, the first lower foot part extending from an end of the first side-plate-side leg part on the side of the main board at an angle to the first side-plate-side leg part; and a second lower foot part having a second through hole, the second lower foot part extending from an end of the second side-plate-side leg part on the side of the main board at an angle to the second side-plate-side leg part; and a first upper foot part having a first screw hole, the first upper foot part extending from an end of the first rear-plate-side leg part on the side of the main board at an angle to the first rear-plate-side leg part; and a second upper foot part having a second screw hole, the second upper foot part extending from an end of the second rear-plate-side leg part on the side of the main board at an angle to the second rear-plate-side leg part; and the first upper foot part is superposed on a side of the first lower foot part facing away from the main board, and the second upper foot part is superposed on a side of the second lower foot part facing away from the main board.

6. The connector socket module as claimed in claim 1, wherein:

the holder member further comprises a rib part for reinforcement in each of the hollow beam part and the rear plate part.

7. The connector socket module as claimed in claim 1, wherein:

each of the first and second side plate parts comprises a lug fitted to a corresponding cutout part of the relay board, the lug having a part thereof plastically deformed into an engagement piece configured to engage and secure the first face of the relay board.

8. The connector socket module as claimed in claim 1, wherein:

the screw member fixing the relay board to the hollow beam part is a special shaped screw member having an internal thread part in a screw head part thereof.

9. An apparatus, comprising:

a single main board;

a connector socket module mounted on the main board;

a panel configured to form an exterior of the apparatus, wherein the connector socket module includes:

a connector socket module main body;

a holder member configured to hold the connector socket module main body and to cover a side of the connector socket module main body, the holder member being formed by bending a metal plate member of a predetermined shape;

the connector socket module main body and the holder member are fixed to each other;

the connector socket module has the holder member screwed to the single main board, and has the connector socket module main body screwed to the panel;

the connector socket module main body is fixed to the holder member with a special shaped screw member having an internal thread part in a screw head part thereof; and the connector socket module has the special shaped screw member fixed to the panel with a screw screwed into the internal thread part of the special shaped screw member from outside the panel.

10. A connector socket module to be mounted on a main board so as to connect a cable-side connector plug and the main board, the connector socket module comprising:

a connector socket module main body; and a holder structure configured to hold the connector socket module main body, wherein the connector socket module main body includes:

a relay board;

a plurality of I/O connector sockets of which a corresponding one is to be connected to the cable-side connector plug, the I/O connector sockets being arranged on a first face of the relay board; and a mounting connector to be connected to a connector on the main board, the mounting connector being mounted on a second face of the relay board, the second face facing away from the first face of the relay board;

the holder structure is positioned on a side of the second face of the relay board of the connector socket module main body, the holder structure including:

a first frame member shaped so as to extend over the second face of the relay board between a first end and a second end thereof, the first frame member including a relay board reception part and a part to be fixed to the main board, the relay board reception part being configured to receive the second face of the relay board at the first and second ends thereof;

a second frame member shaped so as to extend over the second face of the relay board between the first and second ends thereof, the second frame member including a hook part configured to engage and secure the first face of the relay board at the first and second ends thereof, the second frame member being positioned across the first frame member from the relay board with the hook part engaging and securing the first face of the relay board at the first and second ends thereof; and a screw member screwed into a screw hole of the second frame member so that an end of the screw member presses the first frame member in a direction away from the second frame member; and the relay board has a first part at the first end thereof and a second part at the second end thereof held between the hook part of the second frame member and the relay board reception part of the first frame member.

11. The connector socket module as claimed in claim 10, wherein:

the first frame member and the second frame member are fitted to each other to form a temporary holder structure.

12. The connector socket module as claimed in claim 10, wherein:

a nut for locking is fitted around the screw member; and the nut for locking is pressed against an interior face of the second frame member.

* * * * *